US011707082B2

(12) United States Patent
Rose et al.

(10) Patent No.: US 11,707,082 B2
(45) **Date of Patent: *Jul. 25, 2023**

(54) PROCESS OF PREPARING PRINTING SOLUTION AND MAKING PATTERNED CIGARETTE WRAPPER

(71) Applicant: Altria Client Services LLC, Richmond, VA (US)

(72) Inventors: Marc Rose, Mechanicsville, VA (US); Timothy S. Sherwood, Midlothian, VA (US); Robert N. Smith, Glen Allen, VA (US)

(73) Assignee: Altria Client Services LLC, Richmond, VA (US)

( * ) Notice: Subject to any disclaimer, the term of this patent is extended or adjusted under 35 U.S.C. 154(b) by 632 days.

This patent is subject to a terminal disclaimer.

(21) Appl. No.: 15/421,788

(22) Filed: Feb. 1, 2017

(65) Prior Publication Data

US 2017/0135394 A1 May 18, 2017

Related U.S. Application Data

(63) Continuation-in-part of application No. 13/896,068, filed on May 16, 2013, now Pat. No. 10,375,988, (Continued)

(51) Int. Cl.
*A24D 1/02* (2006.01)
*B41F 9/00* (2006.01)

(52) U.S. Cl.
CPC ..... *A24D 1/025* (2013.01); *B41F 9/003* (2013.01)

(58) Field of Classification Search
CPC ..... A24D 1/025; B41F 9/003
See application file for complete search history.

(56) References Cited

U.S. PATENT DOCUMENTS 1,555,320 A 9/1925 Weil
1,581,451 A 4/1926 Knapp
(Continued)

FOREIGN PATENT DOCUMENTS

BE 779470 A1 6/1972
CA 952656 A1 8/1974
(Continued)

OTHER PUBLICATIONS

Office Action dated Nov. 8, 2018 in corresponding Chinese Patent Application No. 201510524184.6 with English translation, 7 pages.
(Continued)

*Primary Examiner* — Angela C Scott
(74) *Attorney, Agent, or Firm* — Harness, Dickey & Pierce, P.L.C,

(57) ABSTRACT

A process for making patterned cigarette wrapper includes the steps of: preparing a printing solution including the steps of: mixing at least water and a starch to form a starch mixture, heating the starch mixture to a temperature of at least about 180° F. preferably for at least about 30 minutes to release amylopectin and amylose, adding propylene glycol to the starch mixture, and mixing the starch mixture and propylene glycol to form a printing solution, wherein the solution is maintained and applied at elevated temperature (120° F. to 150° F.). The process also includes providing a base web of wrapper and applying the printing solution to the wrapper in a predetermined pattern.

5 Claims, 9 Drawing Sheets

Related U.S. Application Data which is a continuation-in-part of application No. 13/324,747, filed on Dec. 13, 2011, now Pat. No. 9,302,522.

(60) Provisional application No. 61/647,898, filed on May 16, 2012, provisional application No. 61/422,525, filed on Dec. 13, 2010.

(56) References Cited

U.S. PATENT DOCUMENTS

| | | | |
|---|---|---|---|
| 1,581,619 | A | 4/1926 | Sulzberger |
| 1,909,924 | A | 5/1933 | Schweitzer et al. |
| 1,996,002 | A | 3/1935 | Seaman |
| 1,999,222 | A | 4/1935 | Weinberger |
| 1,999,223 | A | 4/1935 | Weinberger |
| 1,999,224 | A | 4/1935 | Miles |
| 2,013,508 | A | 9/1935 | Seaman |
| 2,020,646 | A | 11/1935 | Hornstein |
| 2,022,004 | A | 11/1935 | Larson |
| 2,049,320 | A | 7/1936 | Ruben et al. |
| 2,098,619 | A | 11/1937 | Finnell |
| 2,149,896 | A | 3/1939 | McArdle et al. |
| 2,246,929 | A | 6/1941 | Seney |
| 2,307,088 | A | 1/1943 | Whiteley |
| 2,580,568 | A | 1/1952 | Matthews et al. |
| 2,580,608 | A | 1/1952 | Schur et al. |
| 2,666,437 | A | 1/1954 | Lattof |
| 2,718,889 | A | 9/1955 | Claussen |
| 2,733,720 | A | 2/1956 | Schur et al. |
| 2,754,207 | A | 7/1956 | Schur et al. |
| 2,886,042 | A | 5/1959 | Hoover et al. |
| 2,976,190 | A | 3/1961 | Meyer |
| 2,998,012 | A | 8/1961 | Lamm |
| 3,030,963 | A | 4/1962 | Cohn |
| 3,106,210 | A | 10/1963 | Reynolds |
| 3,370,593 | A | 2/1968 | Owaki |
| 3,395,714 | A | 8/1968 | Kahane |
| 3,409,021 | A | 11/1968 | Owaki |
| 3,477,440 | A | 11/1969 | Licis |
| 3,511,247 | A | 5/1970 | Tamol |
| 3,517,672 | A | 6/1970 | Michelson |
| 3,526,904 | A | 9/1970 | Tamol |
| 3,633,589 | A | 1/1972 | Kahane et al. |
| 3,640,285 | A | 2/1972 | Briskin et al. |
| 3,667,479 | A | 6/1972 | Sanford et al. |
| 3,699,973 | A | 10/1972 | Tamol et al. |
| 3,705,588 | A | 12/1972 | Tamol et al. |
| 3,722,515 | A | 3/1973 | Reynolds et al. |
| 3,782,393 | A | 1/1974 | Michelson |
| 3,805,799 | A | 4/1974 | Stewart, Jr. et al. |
| 3,903,899 | A | 9/1975 | Musillo |
| 3,908,671 | A | 9/1975 | Cogbill, II |
| 3,911,932 | A | 10/1975 | Houck, Jr. et al. |
| 4,020,850 | A | 5/1977 | Cogbill, II |
| 4,038,992 | A | 8/1977 | Ogasa et al. |
| 4,044,778 | A | 8/1977 | Cohn |
| 4,061,147 | A | 12/1977 | Falchi |
| 4,077,414 | A | 3/1978 | Baker et al. |
| 4,088,142 | A | 5/1978 | Horsewell et al. |
| 4,129,134 | A | 12/1978 | Hind et al. |
| 4,146,040 | A | 3/1979 | Cohn |
| 4,149,550 | A | 4/1979 | Green et al. |
| 4,187,862 | A | 2/1980 | Cohn |
| 4,193,409 | A | 3/1980 | Wahle et al. |
| 4,225,636 | A | 9/1980 | Cline et al. |
| 4,230,131 | A | 10/1980 | Simon |
| 4,231,377 | A | 11/1980 | Cline et al. |
| 4,236,532 | A | 12/1980 | Schweizer et al. |
| 4,239,591 | A | 12/1980 | Blake |
| 4,277,301 | A | 7/1981 | McIntyre et al. |
| 4,286,605 | A | 9/1981 | Goslin et al. |
| 4,295,478 | A | 10/1981 | Yeatts |
| 4,326,543 | A | 4/1982 | Martin et al. |
| 4,340,074 | A | 7/1982 | Tudor |
| 4,371,571 | A | 2/1983 | McIntyre et al. |
| 4,406,295 | A | 9/1983 | Sanford et al. |
| 4,411,279 | A | 10/1983 | Martin et al. |
| 4,450,847 | A | 5/1984 | Owens |
| 4,452,259 | A | 6/1984 | Norman et al. |
| 4,453,553 | A | 6/1984 | Cohn |
| 4,480,650 | A | 11/1984 | Weinert |
| 4,489,738 | A | 12/1984 | Simon |
| 4,590,955 | A | 5/1986 | Dixit |
| 4,607,647 | A | 8/1986 | Dashley et al. |
| 4,615,345 | A | 10/1986 | Durocher |
| 4,619,278 | A | 10/1986 | Smeed et al. |
| 4,619,289 | A | 10/1986 | Tsuru et al. |
| 4,622,983 | A | 11/1986 | Mathews et al. |
| 4,679,575 | A | 7/1987 | Yamaguchi et al. |
| 4,691,717 | A | 9/1987 | Ikeda et al. |
| 4,716,912 | A | 1/1988 | Leonard |
| 4,730,628 | A | 3/1988 | Townsend et al. |
| 4,739,775 | A | 4/1988 | Hampl, Jr. |
| 4,776,355 | A | 10/1988 | Stevenson et al. |
| 4,784,163 | A | 11/1988 | Adams et al. |
| 4,784,164 | A | 11/1988 | Adams et al. |
| 4,889,145 | A | 12/1989 | Adams et al. |
| 4,924,883 | A | 5/1990 | Perfetti et al. |
| 4,924,888 | A | 5/1990 | Perfetti et al. |
| 4,941,486 | A | 7/1990 | Dube et al. |
| 4,942,888 | A | 7/1990 | Montoya et al. |
| 4,945,932 | A | 8/1990 | Mentzel et al. |
| 4,998,542 | A | 3/1991 | Kallianos et al. |
| 4,998,543 | A | 3/1991 | Goodman et al. |
| 5,060,675 | A | 10/1991 | Milford et al. |
| 5,072,744 | A | 12/1991 | Luke et al. |
| 5,074,321 | A | 12/1991 | Gentry et al. |
| 5,085,228 | A | 2/1992 | Mooney et al. |
| 5,092,353 | A | 3/1992 | Montoya et al. |
| 5,094,253 | A | 3/1992 | St. Charles et al. |
| 5,101,839 | A | 4/1992 | Jakob et al. |
| 5,101,840 | A | 4/1992 | Riehl, Jr. |
| 5,103,844 | A | 4/1992 | Hayden et al. |
| 5,105,836 | A | 4/1992 | Gentry et al. |
| 5,105,838 | A | 4/1992 | White et al. |
| 5,107,866 | A | 4/1992 | Aronoff et al. |
| 5,109,876 | A | 5/1992 | Hayden et al. |
| 5,129,408 | A | 7/1992 | Jakob et al. |
| 5,143,098 | A | 9/1992 | Rogers et al. |
| 5,144,964 | A | 9/1992 | Demain |
| 5,144,966 | A | 9/1992 | Washington |
| 5,144,967 | A | 9/1992 | Cartwright et al. |
| 5,152,304 | A | 10/1992 | Bokelman et al. |
| 5,154,191 | A | 10/1992 | Owens, Jr. |
| 5,155,140 | A | 10/1992 | Marten et al. |
| 5,168,884 | A | 12/1992 | Baldwin et al. |
| 5,170,807 | A | 12/1992 | Kasbo et al. |
| 5,178,167 | A | 1/1993 | Riggs et al. |
| 5,191,906 | A | 3/1993 | Myracle, Jr. |
| 5,220,930 | A | 6/1993 | Gentry |
| 5,244,530 | A | 9/1993 | Collins et al. |
| 5,263,500 | A | 11/1993 | Baldwin et al. |
| 5,263,999 | A | 11/1993 | Baldwin et al. |
| 5,271,419 | A | 12/1993 | Arzonico et al. |
| 5,329,004 | A | 7/1994 | Eden et al. |
| 5,342,484 | A | 8/1994 | Cutright et al. |
| 5,345,950 | A | 9/1994 | Adebar et al. |
| 5,396,911 | A | 3/1995 | Casey, III et al. |
| 5,415,186 | A | 5/1995 | Casey, III et al. |
| 5,417,228 | A | 5/1995 | Baldwin et al. |
| 5,450,862 | A | 9/1995 | Baldwin et al. |
| 5,450,863 | A | 9/1995 | Collins et al. |
| 5,464,028 | A | 11/1995 | Takeda et al. |
| 5,465,739 | A | 11/1995 | Perfetti et al. |
| 5,474,095 | A | 12/1995 | Allen et al. |
| 5,490,875 | A | 2/1996 | Wermers et al. |
| 5,490,876 | A | 2/1996 | Warmerdam et al. |
| 5,492,568 | A | 2/1996 | Warmerdam et al. |
| 5,497,793 | A | 3/1996 | Kubica |
| 5,498,224 | A | 3/1996 | Kauffman et al. |
| 5,507,304 | A | 4/1996 | Maheras et al. |
| 5,523,036 | A | 6/1996 | Lake et al. |
| 5,529,619 | A | 6/1996 | Warmerdam et al. |

(56) References Cited

U.S. PATENT DOCUMENTS 5,534,114 A 7/1996 Cutright et al.
5,538,018 A 7/1996 Chan et al.
5,538,019 A 7/1996 Bullwinkel et al.
5,540,242 A 7/1996 Chao et al.
5,589,034 A 12/1996 Hultman et al.
5,595,196 A 1/1997 Salonen et al.
5,598,868 A 2/1997 Jakob et al.
5,613,505 A 3/1997 Campbell et al.
5,641,349 A 6/1997 Koubek et al.
5,690,787 A 11/1997 Hultman et al.
5,702,555 A 12/1997 Caudal et al.
5,709,227 A 1/1998 Arzonice et al.
5,730,840 A 3/1998 Hampl, Jr. et al.
5,732,718 A 3/1998 Douglas et al.
5,820,998 A 10/1998 Hotaling et al.
5,824,190 A 10/1998 Guerro et al.
5,830,318 A 11/1998 Snow et al.
5,878,753 A 3/1999 Peterson et al.
5,878,754 A 3/1999 Peterson et al.
5,882,755 A 3/1999 Igarashi et al.
5,888,348 A 3/1999 Hampl, Jr.
5,893,372 A 4/1999 Hampl, Jr.
5,911,224 A 6/1999 Berger
5,921,249 A 7/1999 Hampl, Jr.
5,974,732 A 11/1999 Saito
5,985,323 A 11/1999 Augello et al.
5,992,420 A 11/1999 Moriyama
5,997,691 A 12/1999 Gautam et al.
6,020,969 A 2/2000 Struckhoff et al.
6,095,152 A 8/2000 Beven et al.
6,129,087 A 10/2000 Wallace et al.
6,198,537 B1 3/2001 Bokelman et al.
6,305,382 B1 10/2001 Hampl, Jr.
6,397,852 B1 6/2002 McAdam
6,568,403 B2 5/2003 Hampl, Jr. et al.
6,584,981 B2 7/2003 Hampl, Jr.
6,596,125 B2 7/2003 Garg et al.
6,606,999 B2 8/2003 Crooks et al.
6,645,605 B2 11/2003 Hammersmith et al.
6,676,806 B1 1/2004 Butt
6,705,325 B1 3/2004 Hicks et al.
6,725,867 B2 4/2004 Peterson et al.
6,779,530 B2 8/2004 Kraker
6,779,531 B1 8/2004 Biggs et al.
6,789,548 B2 9/2004 Bereman
6,799,578 B2 10/2004 Snaidr et al.
6,823,872 B2 11/2004 Hampl, Jr.
6,837,248 B2 1/2005 Zawadzki et al.
6,929,013 B2 8/2005 Ashcraft et al.
6,959,712 B2 11/2005 Bereman et al.
6,976,493 B2 12/2005 Chapman et al.
6,997,190 B2 2/2006 Stokes et al.
7,047,982 B2 5/2006 Seymour et al.
7,073,514 B2 7/2006 Barnes et al.
7,077,145 B2 7/2006 Seymour et al.
7,115,085 B2 10/2006 Deal
7,116,750 B1 10/2006 Iaquinta et al.
7,117,871 B2 10/2006 Hancock et al.
7,195,019 B2 3/2007 Hancock et al.
7,234,471 B2 6/2007 Fitzgerald et al.
7,237,558 B2 7/2007 Clark et al.
7,237,559 B2 7/2007 Ashcraft et al.
7,240,678 B2 7/2007 Crooks
7,275,548 B2 10/2007 Hancock et al.
7,275,549 B2 10/2007 Hancock et al.
7,276,120 B2 10/2007 Holmes
7,281,540 B2 10/2007 Barnes et al.
7,290,549 B2 11/2007 Banerjee et al.
7,296,578 B2 11/2007 Read, Jr.
7,363,929 B2 4/2008 Fagg et al.
8,646,463 B2 2/2014 Sherwood et al.
8,707,967 B2 4/2014 Li et al.
8,733,370 B2 5/2014 Li et al.
8,833,377 B2 9/2014 Li et al.
8,844,540 B2 9/2014 Li et al.
8,905,043 B2 12/2014 Li et al.
8,925,556 B2 * 1/2015 Li ..... A24D 1/025 131/365
8,939,156 B2 1/2015 Li et al.
9,161,570 B2 10/2015 Li et al.
9,302,522 B2 * 4/2016 Sherwood ..... B41M 3/006
10,375,988 B2 * 8/2019 Rose ..... A24D 1/025
2002/0179105 A1 12/2002 Zawadzki et al.
2002/0179106 A1 12/2002 Zawadzki et al.
2003/0131860 A1 7/2003 Ashcraft et al.
2003/0136420 A1 7/2003 Kraker
2003/0145869 A1 8/2003 Kitao et al.
2003/0217757 A1 11/2003 Edelmann
2004/0025894 A1 2/2004 Beven et al.
2004/0074508 A1 4/2004 McAdam et al.
2004/0099280 A1 5/2004 Stokes et al.
2004/0122547 A1 6/2004 Seymour et al.
2004/0123874 A1 7/2004 Zawadzki et al.
2004/0129281 A1 7/2004 Hancock et al.
2004/0134631 A1 7/2004 Crooks et al.
2004/0168695 A1 9/2004 Snaidr et al.
2004/0173229 A1 9/2004 Crooks et al.
2004/0182407 A1 9/2004 Peterson et al.
2004/0231685 A1 11/2004 Patel et al.
2004/0237978 A1 12/2004 Barnes et al.
2004/0238136 A1 12/2004 Patel et al.
2004/0255966 A1 12/2004 Kraker
2004/0261805 A1 12/2004 Wanna et al.
2005/0000528 A1 1/2005 Bereman
2005/0000529 A1 1/2005 Bereman et al.
2005/0000531 A1 1/2005 Shi
2005/0005947 A1 1/2005 Hampl et al.
2005/0016556 A1 1/2005 Ashcraft et al.
2005/0022833 A1 2/2005 Gedevanishvili et al.
2005/0039767 A1 2/2005 Mua et al.
2005/0051185 A1 3/2005 Rasouli et al.
2005/0056293 A1 3/2005 Zawadzki et al.
2005/0056294 A1 3/2005 Wanna et al.
2005/0066980 A1 3/2005 Crooks et al.
2005/0066982 A1 3/2005 Clark et al.
2005/0066984 A1 3/2005 Crooks et al.
2005/0076925 A1 4/2005 Fagg et al.
2005/0076929 A1 4/2005 Fitzgerald et al.
2005/0081869 A1 4/2005 Biggs et al.
2005/0087202 A1 4/2005 Norman et al.
2005/0103355 A1 5/2005 Holmes
2005/0115575 A1 6/2005 Seymour et al.
2005/0115579 A1 6/2005 Beven et al.
2005/0166936 A1 8/2005 Snaidr
2005/0172977 A1 8/2005 Jadot et al.
2005/0178399 A1 8/2005 Shafer et al.
2005/0186257 A1 8/2005 Manegold et al.
2005/0211259 A1 9/2005 Gedevanishvili
2005/0241659 A1 11/2005 Ashcraft et al.
2005/0241660 A1 11/2005 Ashcraft et al.
2006/0005847 A1 1/2006 Chapman et al.
2006/0011207 A1 1/2006 Chapman et al.
2006/0021625 A1 2/2006 Nyffeler
2006/0021626 A1 2/2006 Mua
2006/0037621 A1 2/2006 Bereman et al.
2006/0124146 A1 6/2006 Stokes et al.
2006/0174904 A1 8/2006 Wanna
2006/0207617 A1 9/2006 Seymour et al.
2006/0231114 A1 10/2006 Oglesby et al.
2006/0237024 A1 10/2006 Reich et al.
2006/0243290 A1 11/2006 Reich et al.
2007/0029060 A1 2/2007 Murray et al.
2007/0051381 A1 3/2007 Hancock et al.
2007/0056600 A1 3/2007 Coleman et al.
2007/0084475 A1 4/2007 Oglesby
2007/0095357 A1 5/2007 Besso et al.
2007/0102017 A1 5/2007 Sherwood et al.
2007/0137668 A1 6/2007 Borschke et al.
2007/0144545 A1 6/2007 Long et al.
2007/0157940 A1 7/2007 Mua et al.
2007/0169786 A1 7/2007 Li et al.
2007/0175058 A1 8/2007 Bengi
2007/0295348 A1 12/2007 Wanna
2008/0011312 A1 1/2008 Matsufuji et al.

(56) References Cited

U.S. PATENT DOCUMENTS

| | | | | |
|---|---|---|---|---|
| 2008/0295854 | A1* | 12/2008 | Li | A24D 1/025 131/365 |
| 2011/0155158 | A1 | 6/2011 | Li et al. | |
| 2011/0297168 | A1 | 12/2011 | Li et al. | |
| 2011/0297169 | A1 | 12/2011 | Li et al. | |
| 2011/0297736 | A1 | 12/2011 | Li et al. | |
| 2011/0300299 | A1 | 12/2011 | Li et al. | |
| 2011/0303233 | A1 | 12/2011 | Li et al. | |
| 2012/0031417 | A1 | 2/2012 | Li et al. | |
| 2012/0285477 | A1* | 11/2012 | Sherwood | B41M 3/006 131/365 |
| 2013/0199552 | A1 | 8/2013 | Li et al. | |
| 2013/0306088 | A1* | 11/2013 | Rose | A24D 1/025 131/365 |
| 2016/0073685 | A1 | 3/2016 | Li et al. | |
| 2017/0127718 | A9* | 5/2017 | Rose | A24D 1/025 |
| 2017/0135394 | A1* | 5/2017 | Rose | A24D 1/025 |
| 2019/0364956 | A1* | 12/2019 | Rose | A24D 1/025 |

FOREIGN PATENT DOCUMENTS

| | | | |
|---|---|---|---|
| CN | 10167763 | A | 3/2010 |
| CN | 101677632 | A | 3/2010 |
| FR | 2136767 | A5 | 12/1972 |
| JP | 2007-131591 | A | 5/2007 |
| JP | 2010-529306 | A | 8/2010 |
| RU | 63585 | U1 | 5/2007 |
| WO | WO 02/37991 | A1 | 5/2002 |
| WO | WO 03/088771 | A1 | 10/2003 |
| WO | WO 2005/002370 | | 1/2005 |
| WO | WO 2006/004343 | A1 | 1/2006 |
| WO | WO 2007/020532 | A1 | 2/2007 |
| WO | WO 2007/031965 | A2 | 3/2007 |
| WO | WO 2007/113693 | A2 | 10/2007 |
| WO | WO 2008/146159 | A2 | 12/2008 |
| WO | WO 2008/149241 | A2 | 12/2008 |
| WO | WO 2009/004482 | A2 | 1/2009 |
| WO | WO-2012082757 | A2 | 6/2012 |
| WO | WO 2012/158786 | A1 | 11/2012 |

OTHER PUBLICATIONS

Patentability Opinion dated Oct. 4, 2018 in corresponding Brazilian Patent Application No. BR112013014848-9, 5 pages.
Office Action dated Dec. 1, 2017 in corresponding Canadian Patent Application No. 2,821,282, 4 pages.
Second Office Action dated Mar. 2, 2018 in corresponding Chinese Patent Application No. 10510524184.6 with English translation, 12 pages.
Extended European Search Report dated Jan. 22, 2018 in corresponding European Patent Application No. 17197328.2-1102, 11 pages.
Official Action dated Jun. 25, 2017 in corresponding Chinese Patent Application No. 201510524184.6 with English Translation, 20 pages.
Rowe, Raymond C. et al., "Handbook of Pharmaceutical Excipients—Propylene Glycol," Fourth Edition, Pharmaceutical Press and American Pharmaceutical Association, Chemical Industry Press, p. 598.
Office Action (Communication Pursuant to Article 94(3) EPC) dated Jan. 3, 2019 in corresponding European Patent Application No. 17 197 328.2-1102, 6 pages.
International Preliminary Report on Patentability dated Nov. 27, 2014 for PCT/US2013/041402.
Chapman, Simon et al., "Reduction-Ignition Propensity Cigarettes," Aug. 25, 2004, XP55006441, http://www.health.gov.au/internet/main/publishing.nsf/Content/1526AD854C903649CA256F8E0011ACBE/$File/smoking_rip,pdf [retrieved on Sep. 7, 2011].
Glogan, T., "Making fire-safe cigarettes a hot topic", Tobacco Journal International, vol. 2004, No. 2, Mar. 1, 2004, pp. 64-65.
Norman, Alan B. et al., "Measurement of Gas Diffusion Capacity of Cigarette Papers", Beiträge zur Tabakforschung International/Contributions to Tobacco Research, vol. 21, No. 8, pp. 425-434.
Rossel, Stefanie, "Canada's burning issue", Tobacco Journal International, vol. 2005, No. 4, Aug. 1, 2005, pp. 88-91, XP002562192.
"Standard Test Method for Measuring the Ignition Strength of Cigarettes", ASTM International, Designation E2187-4, pp. 1-8, published Aug. 2004.
"Standard Test Method for Measuring the Ignition Strength of Cigarettes", ASTM International, Designation E2187-09, pp. 1-8, published Jan. 2010.
International Preliminary Report on Patentability dated Sep. 30, 2008 for PCT/IB2007/002118.
International Search Report and Written Opinion dated Dec. 23, 2008 for PCT/IB2008/002399.
International Search Report and Written Opinion dated Dec. 23, 2008 for PCT/IB2008/002463.
International Search Report and Written Opinion dated Jan. 5, 2009 for PCT/IB2008/001839.
Partial International Search Report dated Mar. 6, 2009 for PCT/IB2008/002394.
International Search Report and Written Opinion dated Apr. 20, 2009 for PCT/IB2008/001840.
International Search Report and Written Opinion dated Apr. 23, 2009 for PCT/IB2008/002994.
Partial International Search Report dated Jun. 10, 2009 for PCT/IB2008/002635.
International Search Report and Written Opinion dated Aug. 19, 2009 for PCT/IB2008/002635.
International Preliminary Report on Patentability dated Nov. 24, 2009 for PCT/IB2008/002399.
International Preliminary Report on Patentability dated Dec. 1, 2009 for PCT/IB2008/001839.
International Preliminary Report on Patentability dated Dec. 1, 2009 for PCT/IB2008/001840.
International Preliminary Report on Patentability dated Dec. 1, 2009 for PCT/IB2008/002463.
International Preliminary Report on Patentability dated Jan. 14, 2010 for PCT/IB2008/002635.
International Preliminary Report on Patentability dated Feb. 2, 2010 for PCT/IB2008/002394.
International Preliminary Report on Patentability dated Mar. 2, 2010 for PCT/IB2008/002994.
International Search Report and Written Opinion dated Apr. 10, 2012 for PCT/US2011/64676.
Communication Pursuant to Rule 114(2) EPC dated Apr. 15, 2010 for European Appln, No. 07789552.2-2313.
Communication Pursuant to Article 94(3) EPC dated Sep. 14, 2011 for European Appln, No. 08 807 078.4-2302.
International Search Report and Written Opinion dated Jul. 27, 2012 for PCT/US2012/038123.
International Search Report and Written Opinion dated Sep. 24, 2013 for PCT/US2013/041406.
International Search Report and Written Opinion dated Sep. 30, 2013 for PCT/US2013/041395.
International Search Report and Written Opinion dated Sep. 30, 2013 for PCT/US2013/041402.
Official Action dated Nov. 2, 2011 for corresp. Chinese Appln. No. 200880017648.2.
Official Action dated Nov. 10, 2011 for corresp. Chinese Appln. No. 200880024668.2.
Commonly Owned U.S. Appl. No. 61/064,439, filed Mar. 8, 2009.
Commonly Owned U.S. Appl. No. 12/153,783, filed May 23, 2008.
Commonly Owned U.S. Appl. No. 13/040,617, filed Mar. 4, 2011.
Commonly Owned U.S. Appl. No. 13/212,050, filed Aug. 17, 2011.
Commonly Owned U.S. Appl. No. 13/212,058, filed Aug. 17, 2011.
Commonly Owned U.S. Appl. No. 13/212,064, filed Aug. 17, 2011.
Commonly Owned U.S. Appl. No. 13/212,081, filed Aug. 17, 2011.
Commonly Owned U.S. Appl. No. 13/212,091, filed Aug. 17, 2011.
Commonly Owned U.S. Appl. No. 13/212,095, filed Aug. 17, 2011.
Commonly Owned U.S. Appl. No. 13/473,007, filed May 16, 2012.
Commonly Owned U.S. Appl. No. 13/324,747, filed Dec. 13, 2011.
Commonly Owned U.S. Appl. No. 13/896,087, filed May 16, 2013.

(56) References Cited

OTHER PUBLICATIONS

European Search Report dated Oct. 14, 2015 for corresponding Application No. 13790971.9.
International Preliminary Report on Patentability dated Nov. 27, 2014 fo PCT/US2013/041402.
Oct. 13, 2015 European Communication Pursuant to Article 94(3) EPC issued in European Application No. 11 849 346,9-1302.
Sep. 29, 2015 Japanese Office Action issued in Japanese Patent Application No. 2013-544701 and English translation.
Feb. 10, 2015 Chinese Third Office Action issued in Chinese Application No. 201180067377.3 (with English translation).
Supplemental European Search Report dated Sep. 26, 2014 for European Patent Appln. No. 11849346.9.
Mar. 28, 2014 Chinese Office Action issued in Chinese Application No. 201180067377.3.
Official Action dated Mar. 28, 2014 for corresponding Chinese Appln. No. CN201180067377.3.
International Search Report and Written Opinion dated Apr. 10, 2012 for PCT/US11/64676.
Office Action (Communication Pursuant to Article 94(3) EPC) dated Nov. 14, 2019 in corresponding European Patent Application No. 17 197 328.2-1102, 4 pages.
CA Notice of Allowance dated Nov. 23, 2022 corresponding to U.S. Appl. No. 16/504,622.

* cited by examiner

PROCESS OF PREPARING PRINTING SOLUTION AND MAKING PATTERNED CIGARETTE WRAPPER

This application is a continuation-in-part of pending application Ser. No. 13/896,068 filed May 16, 2013 which claims priority under 35 U.S.C. §119(e) to U.S. provisional Application No. 61/647,898 filed on May 16, 2012, which is a continuation-in-part of application Ser. No. 13/324,747 filed Dec. 13, 2011 which claims priority under 35 U.S.C. §119(e) to U.S. provisional Application No. 61/422,525 filed on Dec. 13, 2010, the entire content of which is incorporated herein by reference.

A measure of the tendency of a smoking article to cause ignition when left placed upon a substrate is the Ignition Propensity value. An Ignition Propensity value, or IP value, of a smoking article should preferably be no greater than about 25%. More preferably, the IP value should be no greater than about 20%; and even more preferably no greater than about 10%. Ignition Propensity or IP is a standard test conducted as set forth in ASTM E 2187-04, "Standard Test Method for Measuring the Ignition Strength of Smoking articles", which is incorporated herein in its entirety by this reference thereto. Ignition propensity measures the probability that a smoking article, when smoldering and placed on a substrate, will generate sufficient heat to maintain smoldering of the tobacco rod. Low values for IP are desirable as such values correlate with a reduced likelihood that a smoldering smoking article, when inadvertently left unattended upon a substrate, will cause combustion in the substrate.

Self Extinguishment ("SE")

Smoking articles exhibiting reduced IP values typically also tend to self-extinguish between puffs during smoldering, which is contrary to adult consumer expectations. Adult consumers do not like having to re-light a cigarette during their smoking experience.

A measure of the tendency for a smoking article to self-extinguish during free burn has been developed and is known as the Self-Extinguishment value. The Self-Extinguishment value or SE value has been found to be a useful indicia of the likelihood of a smoking article to self-extinguish between puffs during smoking. The Self-Extinguishment Average value for a smoking article should preferably be no greater than about 80% and/or the Self-Extinguishment at 0° value (0° indicating that the cigarette is smoldering in horizontal orientation) should be no greater than about 50%, and more preferably no greater than about 25%.

Self-Extinguishment or SE herein is a reference to smoldering characteristics of a smoking article under free burn conditions (away from any substrate). To evaluate SE, a laboratory test is conducted at a temperature of 23° C.±3° C. and relative humidity of 55%±5%, both of which should be monitored by a recording hygrothermograph. Exhaust hood (s) remove combustion products formed during testing. Prior to testing, smoking articles to be tested are conditioned at 55%±5% relative humidity and 23° C.±3° C. for at least 24 hours. To facilitate conditioning, the smoking articles are placed in glass beakers to assure free air access.

SE testing takes place within an enclosure or test box. A single port smoking machine or an electric lighter is used to ignite the smoking articles for the test. During testing, an apparatus or "angle holder" holds the smoking articles to be tested by holding an end at angles of 0° (horizontal), 45°, and/or 90° (vertical). Preferably, twenty (20) smoking articles are tested at each of the 0°, 45°, and 90° positions. If more than one apparatus is used, the apparatuses are preferably positioned such that the smoking articles face away from each other to avoid cross interference. If a smoking article goes out before the front line of the smoldering coal reaches the tipping paper, the outcome is scored as "self-extinguishment"; on the other hand, if the smoking article continues smoldering until the front line of the smoldering coal reaches the tipping paper, then the outcome is scored as "non-extinguishment". Thus, for example, an SE value of 95% indicates that 95% of the smoking articles tested exhibited self-extinguishment under the free burn conditions; while an SE value of 20% indicates that only 20% of the smoking articles tested exhibited self-extinguishment under such free burn conditions.

The SE value may be referred to in terms of "Self-Extinguishment at 0° value", "Self-Extinguishment at 45° value", or "Self-Extinguishment at 90° value", each of which refers to the value of SE at the specified tested angle. In addition, the SE value may be referred to in terms of "Self-Extinguishment Average value", which refers to an average of the three angular positions: namely, an average of (i) the "Self-Extinguishment at 0° value" (level, or horizontal orientation), (ii) the "Self-Extinguishment at 45° value", and (iii) the "Self-Extinguishment at 90° value" (vertical orientation). A reference to "Self-Extinguishment value" or "SE value" does not distinguish between SE at 0°, SE at 45°, SE at 90°, or SE average values and may refer to any one of them.

As noted above, it is desirable to achieve IP performance with a patterned paper that meets and exceeds governmental requirements. As previously noted, achievement of a desired IP performance often adversely impacts the SE performance of the smoking article. Stated differently, while an IP performance of a smoking article may meet or exceed the governmental requirement (i.e., it has a 0% IP value), that level of IP performance typically results in a smoking article that will self-extinguish when the cigarette smolders away from any substrate (i.e., it has an SE value of 100%). Improvement of SE performance while maintaining requisite IP performance constitutes a highly desirable feature for cigarette wrappers and smoking articles constructed from them. Applicants have discovered arrangements of the patch elements on wrapper that provide such improved SE performance while maintaining the desired or requisite IP performance.

SUMMARY

In accordance with this disclosure, an improved cigarette wrapper and smoking article using that wrapper has remarkably low IP and SE values, which values satisfy various governmental regulations and requirements for smoking articles. The improved wrapper exhibits circumferential patch elements of add-on material, where the add-on material is applied in substantially rectangular shapes or patches in a single printing application. The patches have a width measured in the longitudinal direction of the wrapper, which width preferably lies in the range of about 5 to about 10 mm, more preferably in the range of about 6 to about 9 mm. The patches preferably also have a circumferential dimension which lies in the range of about 6 to about 10 mm, more preferably about 7 to about 9 mm, such that the patches of a row are circumferentially spaced from one another by a distance of about 5 mm.

The patches are preferably applied to a base web using an aqueous starch solution containing an anti-wrinkling agent and calcium carbonate. Preferably, the anti-wrinkling agent comprises propylene glycol. Particularly preferred composition of the aqueous starch solution are explained more fully below. Nevertheless, when dried, the add-on material in the patches exhibits a diffusivity in the range of 0 to about 0.2 cm/sec, and preferably in the range of 0 to about 0.1 cm/sec.

Preferably, the add-on material is applied to the base web in a single step, gravure printing operation, which operation includes maintenance of the add-on material at temperatures sufficient to avoid degradation of the aqueous starch solution. Single pass operations with measures to abate wrinkling of the base web have been avoided to present difficult alignment and registration issues encountered in high speed multi-pass operations. Practice of the teachings herein provides a wrapper having enhanced consistency and more predictable ignition propensity (IP) and SE performances.

Preferably, the printed pattern on the base web includes one or more longitudinally extending lanes of spaced apart rows of patches of a nominal add-on rate, together with one or more lanes of test marks adjacent to the lane(s) of patches. Preferably, the test marks are applied to the base web at the same add-on rate as for the patch elements and may comprise a plurality of spaced-apart solid bands of add-on material or other geometric form of sufficient size and/or geometry to facilitate measurement of diffusivity for purposes of quality control. As spaced-apart solid bands, the test marks also can be used to optically inspect the base web during printing operations to confirm presence of desired print patterns along the base web during its conversion.

BRIEF DESCRIPTION OF THE DRAWINGS

Many objects and advantages of the present disclosure will be apparent to those skilled in the art when this specification is read in conjunction with the accompanying drawings, wherein like reference numerals are applied to like patch elements and wherein.

DETAILED DESCRIPTION

Figure 1:
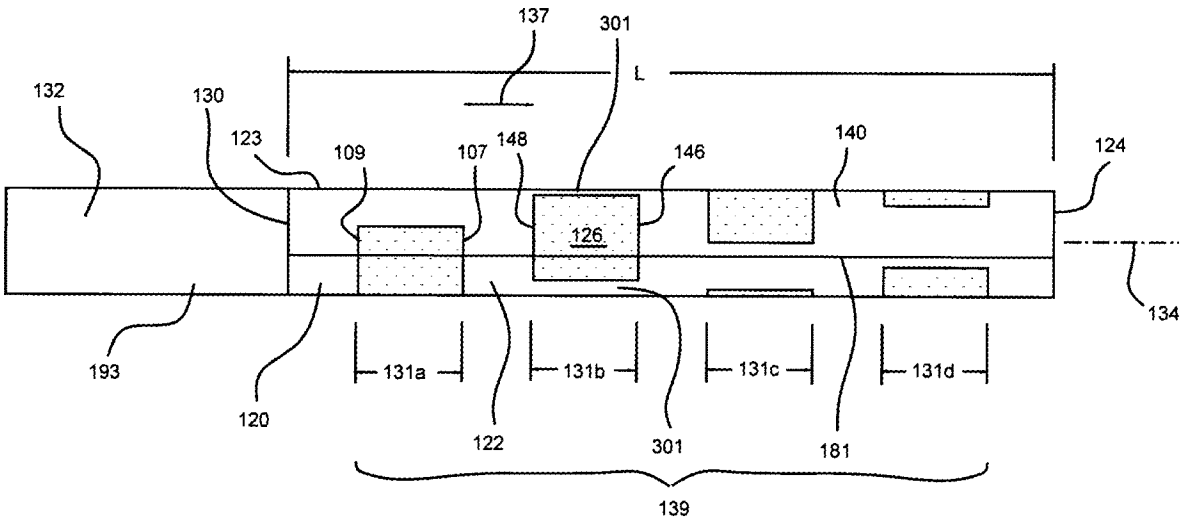
FIG. 1 is a side elevation of a smoking article according to the disclosure, where the patch elements are shown in solid lines for illustrative purposes.
Figure 2:
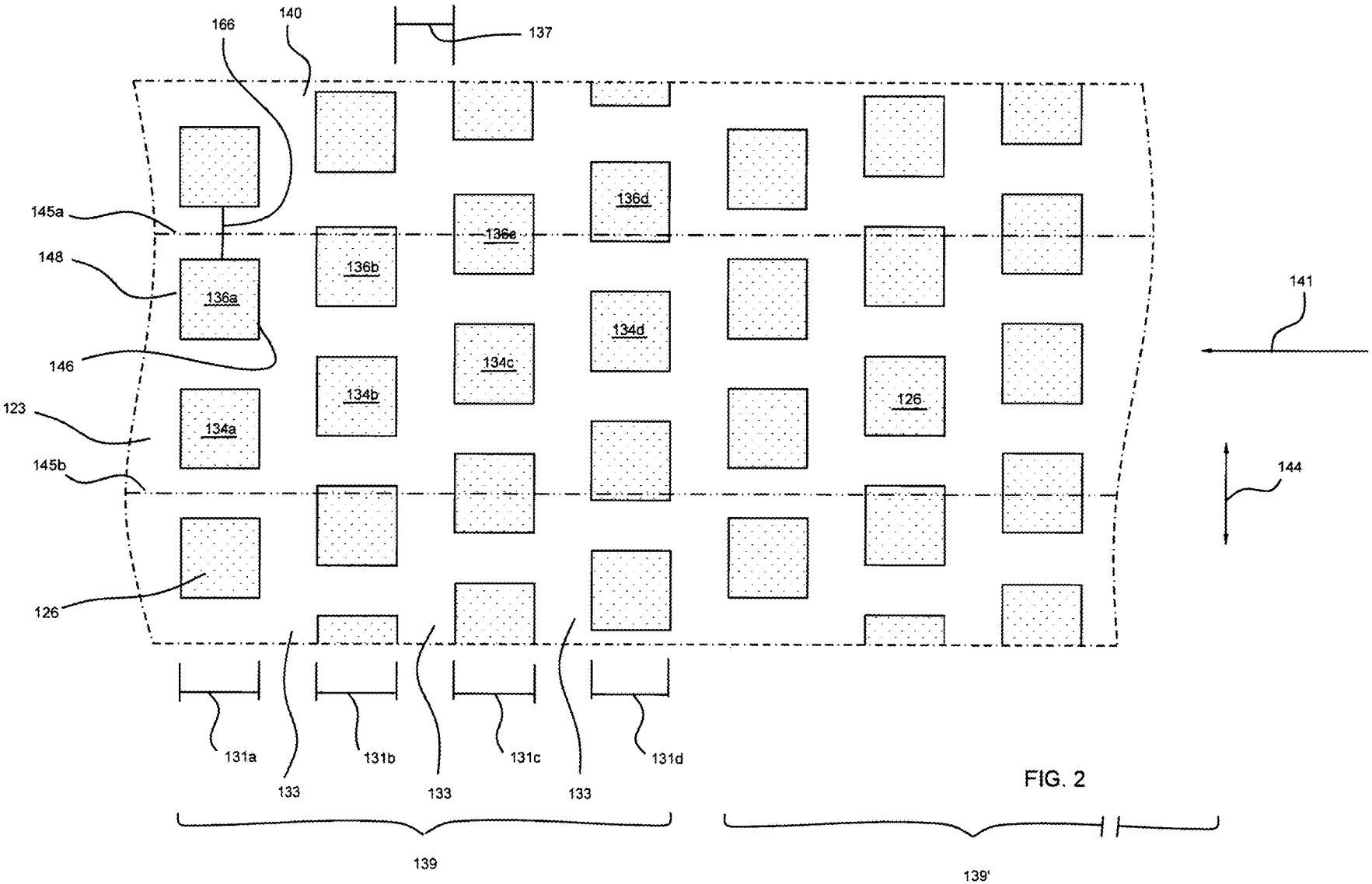
FIG. 2 is a plan view of a portion of a base web with patch elements applied thereto.

Referring to FIG. 1, in a preferred embodiment, a smoking article 120 (e.g., a cigarette) preferably comprises a tobacco rod 122 and optionally a filter 132 attached to the tobacco rod 122 with a tipping paper 193. The tobacco rod 122 comprises a column of smokable material (e.g., tobacco cut filler) and a wrapper 123 disposed about the column of smokable material. Preferably, the wrapper 123 includes a plurality of spaced apart, circumferential rows 131 *a, b, c. d*, each row comprising one or more patch elements (or "patches") 126 of add-on material. The rows 131 *a, b, c, d* and their respective patch elements 126 are configured to obtain extinguishment when a smoldering smoking article 120 is left unattended on a substrate. Preferably, the respective patch elements 126 of adjacent rows 131 *a, b, c, d* are circumferentially off-set from one another, more preferably, each of the second, third, and fourth rows 131 *b, c, d,* respectively are increasingly off-set from the first row 131*a*, and together all four rows 131 *a, b, c, d* define a set of rows 139 (or row set 139). Referring now also to FIG. 2, preferably, row sets 139 are uniformly repeated in the printing of patch elements 126 on the base web 140. It is envisioned that the number of rows 131 within a row set 139 could be other than four (e.g., two, three, five or more), but four is preferred particularly when a row 131 nominally comprises only two patch elements.

Figure 3:
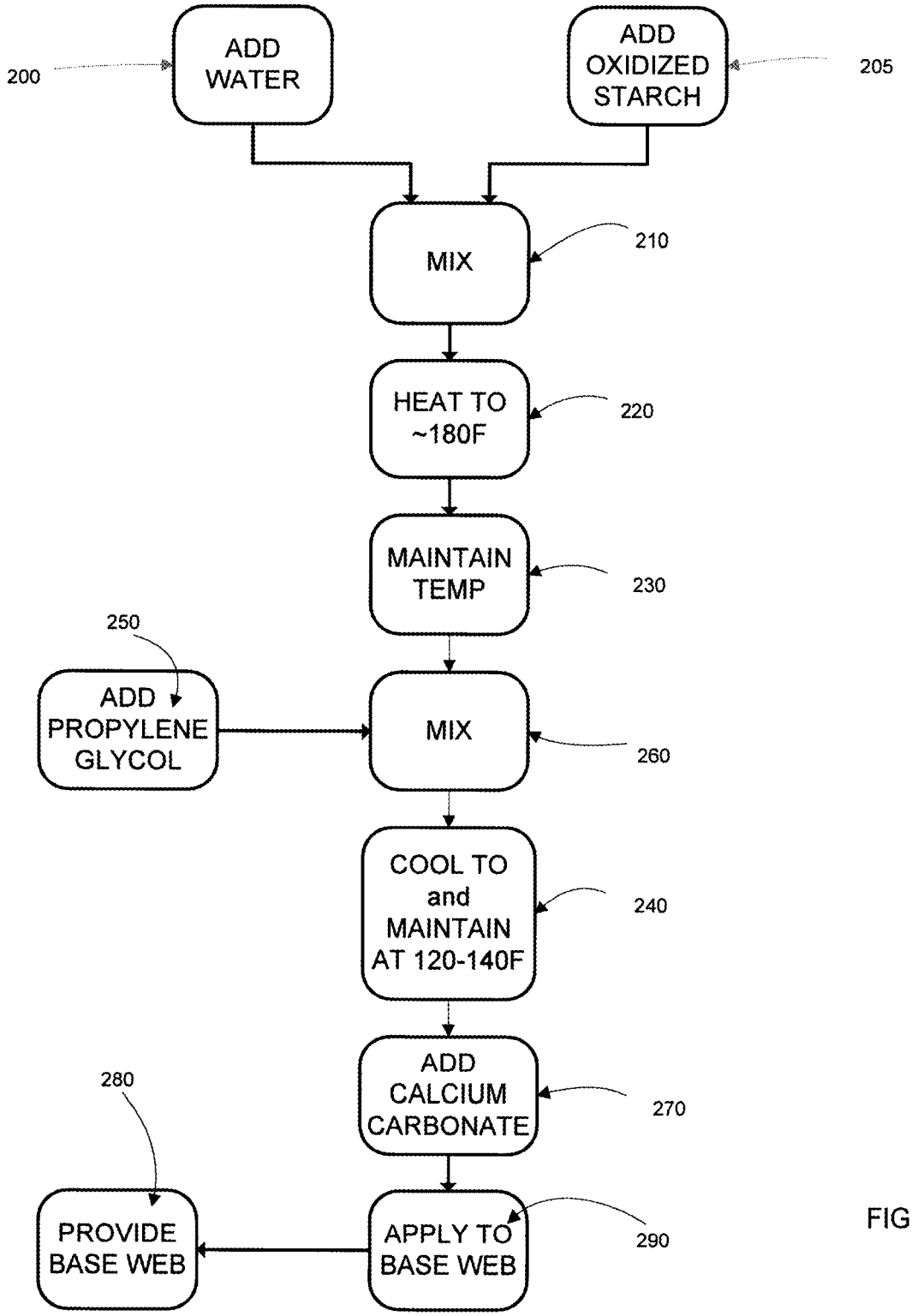
FIG. 3 is a process flow diagram of a process for making and applying an aqueous starch solution to a base web.

Preferably, each patch (or patch element) 126 is rectangular and is formed of an add-on solution which is aqueous and applied in a single pass, gravure printing operation, which operation includes maintenance of the add-on material at temperatures sufficient to avoid degradation of the aqueous starch solution (see FIG. 3). Single pass operations with measure to abate wrinkling of the base web have been found to promote precise printing execution and avoid misalignment or mis-registration issues during high speed multi-pass printing operations. The preferred measures to abate wrinkling include provision of an anti-wrinkling agent in an aqueous starch add-on solution, which preferably also includes calcium carbonate. Another technique to further abate wrinkling (and creasing of cigarette wrapper) is to use a chevron printing pattern for application of the rows 131 of patches 126 (instead of straight lines without angularity), such as described in the teachings which follow with reference to FIGS. 13-14.

Preferably, the material is applied at a rate sufficient to achieve a diffusivity value of about 0 to about 0.2 cm/sec, preferably 0 to about 0.1 cm/sec.

Figure 15:
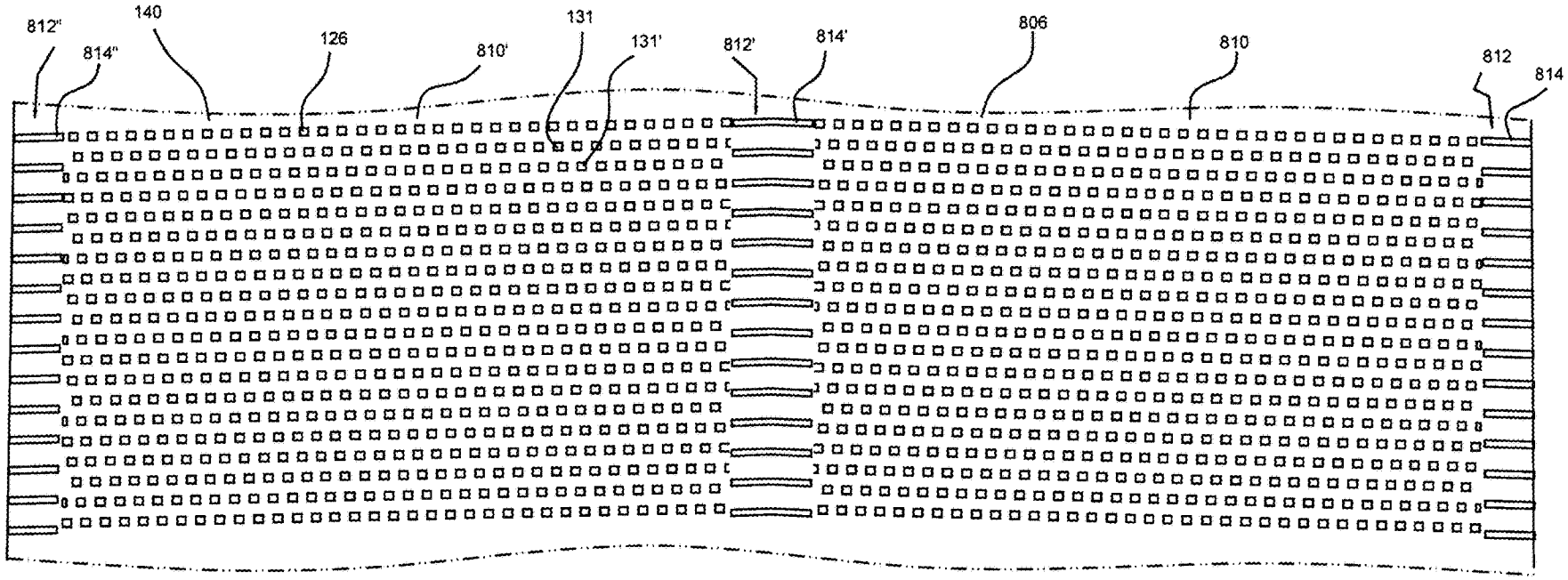
FIG. 15 is a reduced scale view of a base web which includes primary lanes comprising spaced-apart transverse rows of printed patch elements and supplementary lanes comprising spaced-apart transverse test marks in the form of solid banded regions.

Referring now to FIG. 15, preferably, the printed pattern 806 of the base web 140 includes one or more longitudinally extending lanes 810, 810' of spaced apart rows 131, 131' of patches 126 of a nominal add-on rate together with one or more supplemental lanes 812, 812', 812" of spaced apart, test marks 814, 814', 814" adjacent to the lane(s) 810, 810' of patches 126. Preferably, the test marks 814 are applied to the base web 140 at essentially the same add-on rate (i.e., same solution, same engraving depth/cell dimensions) as for the patch elements 126 and may comprise a plurality of spaced-apart solid bands of add-on material or other geometric form of sufficient size and/or geometry to facilitate measurement of diffusivity for purposes of quality control.

In a preferred embodiment, the clamp mechanism of a diffusivity tester encloses a rectangular area of base web of approximately 4 mm by 15 mm. Accordingly, the test marks 810, 810' are sized greater than the enclosed area of the clamp. In this embodiment, the reference marks 810, 810' are sized approximately 5-6 mm wide and extend transversely by at least several inches. The latter could be shortened.

The reference or test marks 810, 810' are configured to make possible testing for diffusivity, whereas the patch elements 126 themselves are not so configured. The ability to measure the diffusivity values in regions bearing the applied add-on material reduces the need to make test cigarettes and to conduct ignition propensity tests of smoldering cigarettes. Instead, the diffusivity of the test marks 810, 810' is measured to confirm or deny by correlation that the patch elements 126 in adjacent portions of the base web are at the desired level of diffusivity and therefore possess the desired level of IP performance. Being able to monitor diffusivity values avoids the waste and cost associated with preparing cigarettes and actually conducting ignition propensity tests. As spaced-apart solid bands, the test marks can also be used to optically inspect the base web during printing operations to confirm presence of desired print patterns along the base web during its conversion. To that end, one lane may be used to test for presence of the desired print patterns, while another lane (of test elements) may be used to test for diffusivity values. The test protocol described herein is applicable to various patterns of occlusive elements formed of add-on material, including without limitation rows of occlusive elements comprising longitudinally spaced-apart, transverse bands, patches and various patterns of occlusive elements such as shown and described in U.S. published application no. 2011/0297736, incorporated herein by reference in its entirety. Suitable optical inspection techniques for determining the presence of occlusive elements may include those described in U.S. Pat. No. 6,198,537, which is incorporated herein by reference in its entirety. Other inspection techniques could be employed, including those which utilize wavelengths other than visible.

All of the above-mentioned teachings and the further details which follow contribute to a wrapper 123 which can provide enhanced and more balanced IP performance and SE performance in smoking articles constructed therefrom. Additionally, with the abatement of wrinkling and single-pass operation, the patches 126 can be precisely and more uniformly printed at commercially acceptable printing speeds, which can be monitored during their construction to assure acceptable levels of quality control. Further details of the preferred embodiments are provided in the description which follows.

DEFINITIONS

As used herein, the phrase "leading edge" refers to the edge 146 (see FIG. 1) of a patch element 126 that is closest to an approaching coal during smoldering of a smoking article 120 whose wrapper 123 contains the patch element 126, while the phrase "trailing edge" refers to the edge 148 of a patch element 126 that is farthest from an approaching coal during smoldering of a smoking article 120 whose wrapper 123 contains the patch element 126.

With reference to FIG. 1, for purposes of this disclosure, "band spacing" or "row spacing" refers to the distance 137 between the trailing edge 148 of patch element 126 in a row 131 and the nearest leading edge 146 of a patch element 126 of an adjacent row 131.

An "anti-wrinkling agent" is a material which abates the tendency of an aqueous starch solution to shrink a base web upon its application and drying. A suitable anti-wrinkling agent may be selected from the group consisting of 1,2 propylene glycol, propylene glycol, and glycerin. Other anti-wrinkling agents can be used in addition to, or in lieu of the preferred materials. For example, other suitable anti-wrinkling agents include polyols, including without limitation, glycerol, polyethylene glycol, glucose, sucrose, isomalt, maltilol, sorbitol, xylitol, and other agents exhibiting comparable functionalities.

For purposes of this disclosure, "layer" refers to a unitary quantity of add-on material applied to a base web from which a wrapper is fabricated. A patch element 126 may be fashioned from one or more layers that may be superimposed on one another; however experience with multi-pass applications has shown a tendency of the base web 140 to wrinkle upon application of an aqueous solution, which confounds proper alignment and registration between applications of the patch pattern, which caused consistency and predictability in a wrapper's IP performance to suffer. Accordingly, it is preferred to apply patch elements 126 in a single-pass gravure operation, and further preferred to include with the single-pass operations measures which abate wrinkling of the base web 140.

For purposes of this disclosure, "longitudinal" refers to the direction along the length of a tobacco rod (e.g., along the axis 134 in FIG. 1), or along the length of a base web 140 (e.g., arrow 141 in FIG. 2) used in the preparation of wrapper that, in turn, may be used to fabricate a tobacco rod, or in the so-called machine-direction of a printing press, i.e., the direction through which a base web is drawn through a print station(s).

For purposes of this disclosure, "transverse" refers to the direction circumferentially around a tobacco rod 122 (see FIG. 1), or transversely of a base web 140 (e.g., arrow 144 in FIG. 2) which corresponds with the so-called cross-machine direction of a printing press.

For purposes of this disclosure and with reference to FIGS. 1 and 2, the "width" of an individual patch element 126 or of a row (or "zone" or "band") 131 of patch elements (e.g., row 131*a*) extends in a longitudinal direction (e.g., the width extends in the direction of axis 134 in FIG. 1 and the arrow 141 in FIG. 2).

In this specification, the unit of measurement for basis weight, gram(s) per square meter, is abbreviated as "gsm".

When the phrase "weight percent" is used herein with respect to the starch component of a starch solution, the "weight percent" is the ratio of the weight of the starch to the total weight of the starch solution. Unless noted otherwise, when the phrase "weight percent" is used herein with respect to any component other than the starch component of a starch solution, the "weight percent" is the ratio of the weight of that other component to the weight of the starch component.

For gravure printing applications, the phrase "single pass" as used in the specification is intended to mean printing using a single cylinder. For other application techniques, the phrase "single pass" is intended to mean a process where the entire band or pattern is applied at one time.

The phrases "self-extinguish under free-burn conditions" or "self-extinguishment" as used herein, refer to the extinguishment of a smoldering cigarette without puffing, when such cigarette is subjected or exposed to free-burn conditions.

When the word "about" is used in this specification in connection with a numerical value, it is intended that the associated numerical value include a tolerance of ±10% around the stated numerical value.

The terms and phrases used herein are not to be interpreted with mathematical or geometric precision, rather geometric terminology is to be interpreted as meaning approximating or similar to the geometric terms and concepts. Terms such as "generally" and "substantially" are intended to encompass both precise meanings of the associated terms and concepts as well as to provide reasonable latitude which is consistent with form, function, and/or meaning.

Smoking Article with Improved Wrapper

Referring again to FIG. 1, a smoking article 120, such as a cigarette, preferably includes a tobacco rod 122 and a filter 132 attached to the tobacco rod 122 with tipping paper 193. Preferably, the tobacco rod 122 comprises a column of shredded tobacco ("cut filler") and a wrapper 123 disposed about the column of tobacco, which wrapper 123 is constructed in accordance with teachings which follow. The tobacco rod 122 has a lightable or lit end 124 and a tipped end 130 (which in the case of non-filter cigarettes, is referenced as the mouth end 130 of the cigarette 120). Cut filler tobacco is an industry-standard designation. Further, the tobacco rod 122 typically has a generally circular cross section, although other oval cross section and other shapes are within the scope of this disclosure. The wrapper is sealed along a longitudinal seam 181 to form the tobacco rod 122.

The tobacco rod has a nominal length "L" measured from the edge 130 of the tipping paper 193 to the lit end 124 of the tobacco rod along a longitudinal axis 134 of smoking article. By way of example, that nominal length may lie in the range of about 50 to about 100 mm.

As shown in FIG. 2, the wrapper 123 is constructed from a base web 140 that may be made from flax, wood pulp, cellulose fiber, or the like, and may have a plurality of patch elements 126 applied to one or both sides of the base web 140. Preferably, the patch elements 126 are applied to the inside of the wrapper 123 in the sense of how the wrapper 123 surrounds a column of tobacco in the tobacco rod 122 (shown in FIG. 1).

Preferably, the transverse dimensions of the wrapper 123 are selected based on the diameter of the finished smoking article (about 5 to about 10 mm) and allowing for overlapping material at a longitudinal seam of about 1 to about 2 mm. For example, allowing for about 2 mm overlapping seams, the wrapper-paper cross-web dimension may be about 27 mm for a smoking article having a circumference of about 24.8 mm.

The wrapper includes a base web which typically is permeable to air. Permeability of wrapper is typically identified in CORESTA units. A CORESTA unit measures paper permeability in terms of volumetric flow rate (i.e., $cm^3$/sec) per unit area (i.e., $cm^2$) per unit pressure drop (i.e., cm of water). The base web of conventional wrapper also has well-known basis weights, measured in grams per square meter, abbreviated as "gsm". The permeability and basis weight for base web of typical smoking article papers commonly used in the industry are set out in the table below:

| Permeability, CORESTA units | Basis Weight, gsm |
|---|---|
| 24 | 25 |
| 33 | 24-26 |
| 46 | 24-26 |
| 60 | 26-28 |

For purposes of this description, the base web of a preferred wrapper has a permeability of at least about 20 CORESTA units. Most preferably, the wrapper has a permeability greater than about 30 CORESTA, such as common base webs having nominal permeabilities of about 33 and about 46 CORESTA with a basis weight of about 25 gsm. For some applications, the base web may have a permeability of greater than about 60 CORESTA, or greater than about 80 CORESTA, or even higher permeability values, with a basis weight of about 26 gsm or greater.

Depictions of cross sections taken through a patterned paper, such as FIGS. 7-10, are believed to be useful schematic representations of a paper web having patch elements fashioned from one or more layered applications, and of the application processes by which such patterned papers are fabricated. Nevertheless, those representations are schematic and are not scale representations of the actual patch elements or relative paper thickness.

Each layer of add-on material may be substantially continuous, may have a uniform or variable thickness, and/or may have a smooth or rough surface.

Thus, schematic descriptions of paper with one or more layers of add-on material are at significant variance with the real world results of applying one or more layers of add-on material to a base web 140. Accordingly, the schematic representations of add-on layers fairly show the process application rates, as might be used as a guide to etch application patch elements of a gravure print cylinder or the like. However, those schematic representations do not accurately represent the actual structure of the finished wrapper prepared by applying one or more layers of add-on material to a base web.

Techniques other than gravure printing may be used to produce the desired patches 126, such a xerographic printing, digital printing, coating or spraying using a template, or any other suitable technique or including a separate step for establishing material-free regions. However, single-pass, gravure printing techniques are preferred.

Diffusivity

When using the preferred add-on solutions, base webs and application techniques of the teachings which follow, a printing solution, upon its application to a base web and drying, forms an air-occlusive film on the base web that is effective to locally reduce diffusivity values from a diffusivity level of approximately 2 cm/sec or greater (for the base web in its original condition) to a value in the range of 0.0 to about 0.2 cm/sec, more preferably less than approximately 0.1 cm/sec, as measured by a Sodim $CO_2$ Diffusivity Tester (purchased from Sodim SAS of France). To measure the diffusivity of a piece of paper using a Diffusivity Tester, the paper is positioned within a clamping head so that the paper separates two vertically arranged chambers. The upper chamber contains a carrier gas, such as nitrogen, while the lower chamber contains a marker gas, such as carbon dioxide. As there is no pressure difference between the two chambers, any migration of gases is due to differences in concentrations of the gases, and there is no permeability effect, which occurs when a pressure difference is maintained between two surfaces of the paper. After a predetermined period of time (e.g., for a predetermined time of about 25 seconds or less), the concentration of carbon dioxide within the nitrogen stream of the upper chamber is measured in an analyzer. A computer then converts the detected level of concentration into a measure of diffusivity.

Preparation of Add-on Material

As described in U.S. Patent Application Publication No. 2008/0295854 filed May 23, 2008, the entire content of which is incorporated by reference thereto, preferably, a film-forming composition may be used to form the patch elements 126. The film-forming composition comprises water and a high concentration of an occluding agent, e.g., about 14% to about 50% by weight of the water plus the occluding agent. The film-forming compound can include one or more occluding agents such as starch, alginate, cellulose, or gum and may further include calcium carbonate as a filler. Further, the film-forming composition preferably includes an anti-wrinkling agent. Where starch is the film-forming compound, a concentration of about 16% to about 26% may be particularly advantageous, and a concentration of about 21% A is presently most preferred.

To improve the ignition propensity characteristics of a smoking article fashioned from the wrapper, the pattern is preferably applied with a printing solution containing an oxidized starch and formed by a process as described herein. Preferred printing characteristics and film-forming characteristics of the add-on material may be achieved using an aqueous oxidized starch solution having a viscosity ranging from about 40 centiPoises (cP) to about 80 cP as measured using a Brookfield RVDV-2 viscometer with a #1 spindle at 20 rotations per minute (rpm) as measured at 120° F., more preferably in the range of about 40 cP to about 60 cP. At the press or at time of printing, the viscosity is adjusted by an addition of hot water and/or heat to achieve a preferred final, print solution having a viscosity of about 16.5 to about 19.5 seconds, as measured by a Zahn #2 cup at 120° F., more preferably about 17 seconds to about 19 seconds. Starch employed for the printing solution preferably may be initially mixed with water to form an aqueous starch mixture having a solids content of about 29% to about 34% (by weight), more preferably about 30% to about 33% (by weight). While various starches may be used, for purposes of this invention it is preferred, without limitation, to use an oxidized starch. Preferred oxidized starches include an oxidized tapioca starch, such as FloMax® 8 available from National Starch, LLC (now Ingredion). The type (e.g. tapioca) and treatment (e.g. oxidation) provides starch components (e.g. amylose and amylopectin) that are in the preferred molecular weight range.

Preferably, the printing solution also includes 1, 2-propylene glycol, in amounts sufficient to abate the tendency of the base web to wrinkle in the course of applying and drying an aqueous starch solution during printing (the "anti-wrinkling" effect of propylene glycol). It is presently understood that this effect is achieved at inclusion levels which result in there being, in the final wrapper, a presence of propylene glycol in the bands at a basis weight level of about 0.2 to 0.5 grams per square meter or more. Further teachings regarding inclusion levels of propylene glycol and other "anti-wrinkling" agents are set forth in U.S. Patent Application Ser. No. 61/064,438, "Patterned Wrapper with an Anti-Wrinkling Agent," filed Mar. 5, 2008, the content of which is incorporated herein by this reference thereto.

A presently preferred solution may comprise at the press (all percentages here being based on the total solution weight): starch—in an amount of about 18 to about 23 wt % (weight-percent), more preferably about 20 to about 22 wt %, and even more preferably about 21 wt % of the total solution weight; propylene glycol—in an amount ranging from about 7 to about 10 wt %, more preferably about 7 to about 9 wt %, and even more preferably about 8 wt % of the total solution weight; calcium carbonate—in an amount in the range of about 9 to about 13 wt %, more preferably about 10 to about 12 wt %, and even more preferably about 11 wt % of the total solution weight; with water essentially comprising the remainder (in an amount ranging from about 55 to about 65 wt %, more preferably about 60 wt %).

It has been further discovered that at preferred inclusion levels, and upon addition of propylene glycol at or near the conclusion of cooking of the aqueous oxidized starch solution, the propylene glycol has additional beneficial effects. Upon its inclusion in a cooked aqueous starch solution, it abates the tendency of the starch components to retrograde or gel, so as to act as a stabilizing agent. It also provides anti-microbial effects in the resulting printing solution. Both of these effects enhance the shelf life of the printing solution. The enhanced shelf life of the printing solution makes it possible to prepare the solution remotely from where printing operations are to occur and to ship the solution. As will be further explained in the teachings which follow, the operational shelf life of the printing solution is further enhanced by maintaining the printing solution in the range of 120 to 150° F., more preferably about 120° F. to about 140° F., during transit and/or at the time of printing. Furthermore, inclusion of propylene glycol in the process as taught herein also has the effect of reducing the printing solution's viscosity to levels which further promote its printability.

Preferably, a conventional filler material, such as calcium carbonate, may be included in the printing solution, as desired, to lighten the printed material to make it less visible on the wrapper and to improve self extinguishment performance of the finished smoking article. Preferably, if included, the calcium carbonate is added to the printing solution just before printing. The calcium carbonate may also help abate wrinkling of the wrapper by reducing the water content in the applied solution. Preferably, the printing solution has a pH in the range of about 4 to about 8, more preferably about 7 to about 8 after calcium carbonate has been added thereto.

Furthermore, the predetermined pattern of printing solution is typically applied to a base web having a permeability in the range of about 10 to about 80 CORESTA units. Preferably, the printing solution forms a film on the base web, when dry, that is effective to locally reduce diffusivity values in the range of 0 to about 0.20 centimeters per second (cm/sec) as measured by a Sodim $CO_2$ Diffusivity Tester (available from Sodim SAS of France, more preferably diffusivity values in the range of 0 to about 0.10 cm/sec.

Various balances or trade-offs need to be made in selection of starch parameters for use in applying films to wrapper. For example, while high molecular weight starch may give rise to effective diffusivity reduction, such high molecular weight starches are of lower solubility, and consequently, must be used in lower concentrations, resulting in a printing solution and with very high water content, which elevates drying requirements and exacerbates the wrinkling of the base web.

In the preferred embodiment, as shown in FIG. 3, the printing solution is prepared by adding water 200 and adding oxidized starch 205 to a container in a batch process. The preferred embodiment provides a batch process. In the batch process, the water and an oxidized starch are mixed (step 210) at about 75° F. at low speeds of about 15 rotations per minute (rpm) to disperse the starch granules in water and form an aqueous oxidized starch mixture having a pH in the range of about 4 to about 5.5. In the preferred embodiment, the water may be heated to about 75° F. or more before adding (step 205) the oxidized starch thereto. Upon mixing (step 210), the oxidized starch mixture is then heated (step 220) to a temperature in the range of at least about 180° F. to at least about 200° F., more preferably about 195° F. Preferably, the temperature is raised over a preferred time interval of about 60 to about 90 minutes, preferably with agitation so as to assure uniformity. Also preferably, the temperature of the heated oxidized starch mixture is then "cooked" by maintaining (step 230) the solution at the aforementioned selected temperature in the range of about 180° F. to about 200° F., preferably at about 195° F. while mixing for at least about 30 minutes, more preferably at least about 45 minutes. During the heating and maintaining steps, the starch granules (detectable under a microscope) are believed to absorb water, swell, rupture, and release amylose and/or amylopectin into the solution.

After the heating (step 220) and the maintaining (step 230) the temperature of the aqueous oxidized starch solution, the process preferably also includes adding (step 250) propylene glycol to the aqueous oxidized starch solution and mixing (step 260) while holding the temperature substantially constant either at aforementioned, selected temperature, or more preferably, at or about 180° F. If, when adding propylene glycol, it is at room temperature, the temperature of the solution may drop from the aforementioned 195° F. to a temperature of about 180° F. Once the propylene glycol is added (step 250), the aqueous oxidized starch solution is mixed for at least about 30 minutes to thoroughly disperse the propylene glycol throughout the aqueous oxidized starch solution.

Preferably, the aqueous oxidized starch solution is continuously mixed during the heating (step 220), the maintaining (step 230), and after the adding (step 250). Preferably, the propylene glycol is maintained at room temperature or higher before its addition to the aqueous oxidized starch solution. Moreover, the propylene glycol is preferably added as quickly as possible to the aqueous oxidized starch solution. In a batch process, for example, the aqueous oxidized starch mixture can be mixed using low speed, low shear mixing of about 15 rpm in a 1000 gallon tank during the heating (step 220), during the maintaining (step 230), and after the adding propylene glycol to the aqueous oxidized starch solution (step 250). Preferably, the mixing (step 260) is conducted while the solution is at an elevated temperature, preferably at about 180° F. or above.

In an alternative embodiment, the heating (step 220) can be accomplished by use of a jet cooker, which produces cooked starch on a substantially continuous basis "on demand", where liquid heated to at least about 180° C. is jetted against an impaction surface to break-up granular structures of the starch in the liquid.

Not wishing to be bound by theory, it is believed that by maintaining the temperature of the aqueous oxidized starch mixture at or above about 195° F., any remaining starch granules are caused to swell, rupture, and release amylose and/or amylopectin therefrom. By adding propylene glycol thereafter, it is believed that the propylene glycol substantially abates recombination thereof so that the film forming capability/capacity of the starch printing solution is preserved for an extended period of time. Moreover, the propylene glycol stays in solution with the starch to provide a substantially homogenous mixture having a low viscosity of less than about 100 cP, more preferably less than about 60 cP, more preferably about 40 cP to about 60 cP when measured using a Brookfield RVDV-2 viscometer with a #1 spindle at 20 rpm at 120° F.

Moreover, it is believed that the addition of propylene glycol to the aqueous oxidized starch solution provides stability and anti-microbial effects, and therefore, improved shelf-life to the printing solution. These effects are evidenced by the solution pH, which does not change (i.e., is substantially constant) for several days after the printing solution has been prepared.

After addition of propylene glycol (step 250) and the mixing (step 260), the printing solution may be cooled (step 240) to a temperature ranging from about 120° F. to about 140° F. Preferably, the printing solution is maintained at a temperature at about or greater than about 120° F. to avoid agglomeration and viscosity increase. It has been found that as the solution temperature drops below about 100° F., retrogradation accelerates resulting in undesired gelling of the solution. Once the gelling effect begins, the retrograded condition of the solution is irreversible.

At a temperature of about 120° F., the printing solution prior to initiation of printing operations preferably has a viscosity of about 40 cP to about 60 cP as measured using a Brookfield RVDV-2 viscometer with a #1 spindle at 20 rpm at 120° F. Also preferably, at a temperature of about 120° F. the printing solution has a pH of about 4 to about 5. At the press, just prior to initiation of printing operations either an addition of hot water or an increase in temperature (not higher than 150° F.) or both may be used to achieve a desired, final printing viscosity (in the range of about 16.5 to 19.5 sec, more preferably about 17 to 19 sec).

In one embodiment, the printing solution may then be stored in drums/totes and at a temperature of about 120° to about 140° F. until use at the time of printing. The drums/totes can be transported using an insulated blanket or heated truck, as needed, while maintaining the drums at a temperature of at least about 120° F. The drums/totes can also be stored under heated conditions. In the preferred embodiment, the printing solution may also be continuously agitated at low speed during storage. Preferably, the printing solution is used within 72 hours of production. The aforementioned maintenance of temperature, together with the addition of the propylene glycol provide stability to the solution such that a shelf-life of at least 2 or 3 days or longer is achievable.

In the preferred embodiment, the process may also preferably include adding (step 270) calcium carbonate to the printing solution. In the preferred embodiment, about 300 pounds of the printing solution can be mixed with about 40 pounds of water and about 40 pounds of calcium carbonate while mixing for about 15 to about 25 minutes. Preferably, the mixture is mixed using a Neptune impeller at low speed to suspend the calcium carbonate (or chalk) in the mixture, avoid foaming, and form a printing solution. The calcium carbonate is preferably added just before printing so that the calcium carbonate does not settle out of solution.

At the converter/printer, the printing solution can then be pumped to a run drum of a printing press. Preferably, the final printing solution (after addition of water and calcium carbonate) has a pH of about 7 to about 8 and a viscosity of about 20 cP as measured using a Brookfield RVDV-2 viscometer with a #1 spindle at 20 rpm at 120° F.

At the press, the process also includes providing a base web of wrapper (step 280) and applying the printing solution to the base web to form a cigarette wrapper (step 290).

In the preferred embodiment, the printing solution allows for higher starch loading to the base web, uses less water, and the propylene glycol has a greater anti-wrinkling effect due to a higher concentration of propylene glycol with respect to the water content. These features synergistically substantially reduce wrinkling of the base web and reduce the viscosity of the printing solution so as to enhance printability. For example, after application to a 33 CORESTA base web for a 6.8 mm wide solid band, with a 27 mm band period, about 0.9 grams per square meter ($g/m^2$) starch, about 0.4 $g/m^2$ propylene glycol and about 0.4 $g/m^2$ calcium carbonate is deposited on the base web.

The following examples are given to illustrate embodiments of the process described herein and should not be construed to limit the scope of such embodiments.

Example 1

Oxidized starch and water are mixed at about 75° F. and heated to about 195° F. for about 45 minutes with low agitation (low shear mixing) to form a mixture. Propylene glycol is added thereto while mixing for about 30 more minutes while maintaining the solution at a temperature of at least about 180° F. The solution is cooled to a temperature of about 140° F. while mixing. The solution is then packed and the temperature of the solution is maintained at a temperature ranging from about 120° F. to about 140° F. and transported to a location of a press.

The solution contains about 31° A (by weight) starch, about 10% (by weight) propylene glycol and about 59% (by weight) water. At the press or printing operation, about 300 pounds of the solution is then mixed with 40 pounds hot water and about 40 pounds calcium carbonate to form a printing solution having about 21% (by weight) starch, about 8% (by weight) propylene glycol, about 60% (by weight) water and about 11° A (by weight) calcium carbonate to form a final, preferred printing solution.

The solution exhibited desired printability and film-forming characteristics.

Example 2

About 51 pounds water heated to a temperature of about 70° F. to about 80° F. is mixed with about 31 pounds of starch powder, such as FloMax® 8 available from National Starch, LLC (now Ingredion). The water and starch powder are further mixed while heating for about 45 minutes to a temperature of about 200° F. to form an aqueous oxidized starch solution. About 10 pounds of either condensed steam or additional water heated to about 200° F. is added to the aqueous oxidized starch solution. The aqueous oxidized starch solution is tested using an oven bake method and has a solids content of about 31%. The viscosity is tested using a Brookfield RVDV-2 viscometer with a #1 spindle at 20 rpm at 120° F., and the aqueous oxidized starch solution is found to have a viscosity of about 50 cP. The aqueous oxidized starch solution has a pH of about 4 to about 5.

About 8 pounds of propylene glycol are then added to the aqueous oxidized starch solution and is mixed for about 30 minutes at a temperature ranging from about 180° F. to about 200° F. The printing solution is then cooled to a temperature of about 130° F. The viscosity is tested again using a Brookfield RVDV-2 viscometer with a #1 spindle at 20 rpm at 120° F., and the printing solution is found to have a viscosity of about 45 cP. Such evidences the favorable effect of the propylene glycol to reduce viscosity. The printing solution is kept under substantially constant agitation, the intensity of which is dependent upon tank size, dimensions and agitator type. Calcium carbonate is added while mixing to suspend the calcium carbonate and form a printing solution which is maintained at a temperature of about 120° F. to about 130° F. The printing solution contains about 54.5 pounds of water, about 24.5 pounds of pounds starch, about 10.5 pounds calcium carbonate, and about 10.5 pounds propylene glycol; and has a viscosity of about 17.5 sec to about 18.5 sec as measured by a Zahn #2 cup at 120° F.

As an alternative, turbidity of the aqueous oxidized starch and propylene glycol solution can also be measured to identify changes in the aqueous oxidized starch and propylene glycol solution before viscosity changes are noticed using viscosity measurements. Turbidity measures the amount of light transmitted through a given quantity of material, and can thus be used as a quality control tool to determine if the aqueous oxidized starch and propylene glycol solution should be used or discarded prior to mixing with calcium carbonate. Thus, the turbidity measurement can be used to determine the film-forming capability of the aqueous oxidized starch and propylene glycol solution.

In practicing the preferred embodiment of this invention, the step of maintaining the solution temperature in the range of about 120° to about 150° F. provides numerous advantages including, without limitation, permitting high starch content to be attained and maintained in the aqueous solution and lowering the aqueous solution's viscosity. Accordingly, through use of the temperature maintenance step until the printing step, a desired printing solution is achieved, which solution is suitable for a single pass application to a base web.

When propylene glycol is applied as an anti-wrinkling agent in accordance with this specification, the propylene glycol also counteracts the tendency of certain microorganisms to thrive in a starch solution at a temperature in the range of about 120° to about 150° F.

The film-forming composition may be applied to the base web of the wrapper 140 using gravure printing, digital printing, coating or spraying using a template, or any other suitable technique. Because of the intricate dimensions of the material-free regions of the various embodiments, a single-pass gravure printing operation is preferred. However, if desired, the patch elements 126 of add-on material can be formed by printing multiple, successive layers, e.g., two or more successive layers registered or aligned with one another.

For single-pass gravure printing operations, the preferred aqueous starch solution comprises at least 25% starch by weight; between about 20% and about 35% anti-wrinkling agent (preferably propylene glycol), and between about 30% and about 80% chalk (preferably a fine calcium carbonate) (percentages here being based on percent of starch weight). More preferably, the solution may comprise at the press (all percentages here being based on the total solution weight): starch—in an amount of about 18 to about 23 wt % (weight-percent), more preferably about 20 to about 22 wt %, and even more preferably about 21 wt % of the total solution weight; propylene glycol—in an amount ranging from about 7 to about 10 wt %, more preferably about 7 to about 9 wt %, and even more preferably about 8 wt % of the total solution weight; calcium carbonate—in an amount in the range of about 9 to about 13 wt %, more preferably about 10 to about 12 wt %, and even more preferably about 11 wt % of the total solution weight; with water essentially comprising the remainder (in an amount ranging from about 55 to about 65 wt %, more preferably about 60 wt %). Preferably the aqueous starch solution is applied at the press at a temperature between about 120 to 140° F. and is preferably prepared and applied in accordance with those and other teachings of the U.S. patent application Ser. No. 13/324,747, filed Dec. 13, 2011, (Attorney Docket No. 1021238-001292), the entirety of which is incorporated herein by reference. For multi-pass operations, a preferred aqueous solution may comprise approximately 16% starch, 6% chalk or calcium carbonate, and 6% 1,2 propylene glycol (weight percents of solution).

With inclusion of the chalk in this embodiment as described, one may abate the tendency of the patterned paper cigarettes to self-extinguish, enhance appearance of the product to a consumer and achieve these and other associated advantages.

The inclusion of an anti-wrinkling agent (preferably, such as propylene glycol) in an aqueous starch solution used to make patterned wrapper in a manner consistent with the teaching herein can reduce transverse shrinkage to operationally manageable levels, alleviate pronounced wrinkling and essentially eliminate creasing problems that previously presented themselves. Inclusion of an anti-wrinkling agent has been found to have additional benefits, too. Cracking and flaking at patch elements are believed to be alleviated. In addition, it is believed that the presence of the anti-wrinkling agent appears to cause the starch solution to reside more on the surface of the base web with less penetration into that material, and thus enhance film formation. Shrinkage of the wrapper in the vicinity of patch elements formed from an aqueous starch solution that includes an anti-wrinkling agent has been observed to be in the range of about 0.0625 to 0.125 in. for a 36 in. wide base web—a range which does not result in creasing nor excessive waviness in the base web. Furthermore, inclusion of an anti-wrinkling agent in the aqueous starch solution has been found to make possible the application of add-on material to be applied to the base web in a single application, printing pass, or the like, provided that sufficient drying capability is established with such practices. In addition, the shelf life of the aqueous starch solution is materially improved by the inclusion of an anti-wrinkling agent as disclosed herein.

Cigarette Wrapper with Patch Elements

Referring now to FIG. 2, the patch elements 126 of add-on material determine and regulate the IP and SE characteristics of the smoking article. Those patch elements 126 of add-on material are applied to a base web 140 (see FIG. 2) of the wrapper 123, which is then formed into a tobacco rod in conventional cigarette making equipment. Nominal permeability of the base web 140 may be in the range of about 20 to about 100 CORESTA. Currently, the preferred nominal permeability of the base web lies in the range of about 30 to about 70 CORESTA, with the most preferred nominal permeabilities being about 33 and about 60 CORESTA.

The manufacture of base web 140 preferably includes the production of a roll of base web of several feet across (usually about 3 to four feet across or in transverse dimension). The base web is then drawn through a printing press or the like and rewound to produce a roll of patterned paper, which is then slit into bobbins. With reference also to FIG. 2, the base web 140 is in effect slit along the longitudinal lines 145*a*, 145*b*, which has a transverse dimension correlating with the nominal circumference of the smoking article with accommodation for overlap along the seam, as previously discussed. Preferably, pairs of patch elements 126 (such as the patch elements 134*a*, 136*a*) are established between the lines 145*a* and 145*b*, which preferably locate at opposite sides of the tobacco rod 122 in FIG. 1 to establish a row 131 of patch elements.

Each pair of rectangular patches (for example, patches 134*a* and 136*a*—the latter not being visible in FIG. 1) define a circumferential patch row 131 (or "zone" or "band") (for example, the row 131*a*). Preferably, the "width" of the row 131, or the width of each of the two patch elements 134*a* and 136*a* of the row 131*a* is in the range of about 5 to about 10 mm, more preferably, in the range of about 6 to about 9 mm, and even more preferably, in the range of about 6.5 to about 8.5 mm. Moreover, at each circumferential region, such as row 131*a*, the patch elements 134*a* and 136*a* are circumferentially spaced apart such that they are disposed in mutually opposing relation along opposite sides of the wrapper 124 when formed on a tobacco rod 122. Preferably the patch elements 134*a*, 136*a* are circumferentially spaced apart from one another such that they are disposed in a mutually opposing relation along opposite sides of the wrapper 123 of the tobacco rod 122. Preferably, each patch 134*a*, 136*a* extends circumferentially (i.e., in cross-measure relative to the paper web) in the range of about 6 to about 10 mm in cross-measure, more preferably, about 7 to about 9 mm in cross-measure, and even more preferably about 7.5 mm to about 8.5 mm in cross measure.

It is further noted that the portion 133 of base web 140 outside of the patch elements 126 are preferably, essentially free of add-on material. More particularly, the areas between adjacent regions 131*a*, 131*b* and the areas between opposing elements within each region (such as between the opposing elements 134*b*, 136*b* of the region 131*b*) are preferably essentially free of add-on material comprising the patch elements (e.g., patch elements 134*b*, 136*b*).

The longitudinal distance between adjacent regions (such as between rows 131*a*, 131*b*, see FIG. 1) is referenced as row spacing 137 (or band spacing 137), which is preferably about 6 to about 12 mm, and more preferably about 7 to about 11 mm, and even more preferably about 8 to about 10 mm.

Preferably, the respective patch elements 126 (see FIGS. 1 and 2) of adjacent rows 131*a, b, c, d* are circumferentially off-set from one another, more preferably, each of the second, third and fourth rows 131*b, c*, and *d* respectively, are increasingly off-set from the first row 131*a*, and together all four rows 131*a, b, c, d* define a set of rows 139 (or row set 139). Preferably, a sufficient number of regions 131 are established along a given tobacco rod (per selection of band-region width and width of band spacing) that, when the smoking article is placed up on a substrate, that there occurs at least one location along the tobacco rod 122 where the respective pair of patch elements 134 are oriented substantially alongside the tobacco rod 122, such as the opposing pair of patch elements 131*b* in FIG. 1, and a second patch, not shown, on the opposite side of the tobacco rod. It is at or about this portion (location 301) of the tobacco rod 122 where extinguishment is most likely to occur when the smoking article 120 is left to smolder on a substrate. The location along the tobacco rod 122 where this orientation most closely occurs is hereinafter referenced as the "snuffer region 301."

Preferably, four or more patch rows are provided along the nominal length of a tobacco rod. Furthermore, preferably the patches of each patch row 131 are circumferentially offset from the patches of the adjacent patch rows. That offset may be selected such that the patches are offset from one another relative to the axis 134 of the tobacco rod by an angle in the range of about 40° to about 75°, more preferably in the range of about 45° to about 60°, and most preferably about 45°.

Because any particular smoking article 120 might be laid upon a substrate differently from the orientation shown in FIG. 1 and/or because its pattern of patch elements may differ, it is to be realized that the oriented snuffer region 301 may appear at different longitudinal positions along the tobacco rod 122 for different rotational positions of the tobacco rod 122. The pattern of patch elements and the band spacing 137 may be selected such that more than one oriented snuffer region 301 may occur along the tobacco rod 122.

Preferably, each patch element 134, 136 includes sufficient add-on material to reduce the diffusivity of the wrapper at each patch element to 0.0 to about 0.2 cm/sec, and more preferably to the range of 0.0 to about 0.1 cm/sec.

As presently understood, the staggered patch rows of add-on material according to this description permit a smoking article 120 (see FIG. 1) to be designed with an advantageous combination of low IP values and low SE values. The patterns of low permeability patch elements of add-on material provide areas of film-forming compound along the length of the tobacco rod 122 that can cooperate with a substrate to extinguish the lit smoking article 120 when it is placed on that substrate, yet these areas of add-on material (such as a film-forming compound) cause the smoking article 120 to self-extinguish at statistically fewer occurrences when the smoking article 120 is held by an adult smoker in a free-burn condition. Thus, the smoking article 120 can exhibit a reduced ignition propensity while retaining a desirable free-burn quality or low SE value by applying a pattern 130 of film-forming compound to the base web according to this description.

To achieve desirable IP and SE characteristics of the smoking article, a pattern 130 (see FIG. 2) is applied to the base web 140 of the wrapper paper, preferably while the base web 140 is in an unfolded condition, such as shown in FIG. 2, or when the base web comprises a roll of cigarette paper that has yet to be slit into bobbins. An object of this description is to provide wrapper papers which, when formed into a tobacco rod 122, exhibit IP values no greater than 25 and SE values no greater than 50. Even more preferred, is an IP value for the resulting smoking article no greater than about 15; and the most preferred IP value for the resulting smoking article is no greater than about 10. Lower SE values are also desired. In this connection, a more preferred SE value is less than about 25; while the most preferred SE value is less than about 10.

Preferably, the pattern is applied to the base web such that a plurality of circumferentially extending rows 131*a*, 131*b*, 131*c*, 131*d* are disposed at spaced locations along the tobacco rod 122. The add-on material can be applied to one or to both sides of the base web. Preferably, three to six, and most preferably four to six or more, of the rows 131 occur in the nominal length of the tobacco rod 122. More particularly, a row set 139 in a preferred embodiment comprises four rows 131, but could be a fewer or a greater number of rows. Generally, the configuration of patch elements 126 are configured amongst the rows of a given row set 139 such that the occurrence of a snuffer region 301 is assured when the smoking article 122 is placed upon a substrate as previously explained. The occurrence of a complete row set is then assured by making the unit length of a row set 139 (as represented by the designation 139 in FIG. 2) less than the nominal length of the tobacco rod. More particularly, it is desired that an integral number of rows occurs in that nominal length of the tobacco rod. The nominal length of the tobacco rod may, for example, be about 54 mm. By way of example, and without limitation, where four rows of patches having an 8 mm length in the longitudinal direction are used, the spacing between adjacent rows (in the longitudinal direction) would be about 5.5 mm.

Each of the circumferential rows 131*a*, 131*b*, 131*c*, 131*d* has a longitudinal pitch or period along the tobacco rod 122 (i.e., length measured along the tobacco rod from the beginning of one row to the beginning of the adjacent row) which is less than the nominal length of the tobacco rod 122. By selecting the longitudinal pitch length or period at about 25% of the nominal length, four rows will be provided on each tobacco rod 122.

Preferably, the pattern corresponding to row sets 139 may repeat itself at least partially along the length of the tobacco rod 122 and it is envisioned to configure the unit length of a row set 139 such that a multiple of row sets may occur along a tobacco rod 122.

When wrapper paper 140 is formed about tobacco to make a tobacco rod 122, patch elements of add-on material at any longitudinal location are preferably spaced about 180 degrees from each other. Moreover, the ratio of the printed area to available surface area (the area of patch elements of a given patch row divided by the circumference of the smoking article times the width of the patch row and the spacing between adjacent patch rows—that ratio here being defined as the "printed area ratio") is substantially less than one. Preferably, the zone area ratio lies in the range of less than about 20% to less than about 50%, and more preferably in the range of less than about 20% to less than about 35%. More particularly, in some embodiments the zone area ratio for element-occupied area to total area may be less than 30%, and even less that 25%. Generally speaking, it is desirable to keep the zone area coverage ratio low because high values (i.e., closer to 1) are believed to increase carbon monoxide concentration in mainstream smoke.

The patch elements of the pattern 130 may be formed by applying one or more layers of an aqueous film-forming composition to the base web of the wrapper paper to reduce the permeability of the paper in those patch elements. Alternatively, a cellulosic material may also be used to form the patch elements. Where a film-forming composition is used, that film-forming composition preferably may include water and a high concentration of an occluding agent, e.g., 20% to about 50% by weight. The film-forming compound can include one or more occluding agents such as starch, alginate, cellulose or gum and may also include calcium carbonate as a filler. Where starch is the film-forming compound, a concentration of about 21% may be advantageous. The film-forming composition may be applied to the base web of the wrapper paper 123 using gravure printing, digital printing, coating or spraying using a template, or any other suitable technique. For example, the film-forming compounds and methods for applying film-forming compounds described in U.S. application Ser. No. 11/500,918, which is hereby incorporated herein in its entirety by this reference thereto, may be chosen for applying a pattern to the base web of the wrapper paper. If desired, the patch elements of add-on material can be formed by printing multiple, successive layers, e.g., two or more successive layers registered or aligned with one another. Furthermore, when layers are used to form the patch elements of add-on material, the material in layers may be the same of different. For example, one layer may be starch while the next layer may be starch and calcium carbonate (or vice versa).

The presently preferred embodiment for the pattern 139 of patch elements of add-on material is illustrated in FIG. 2. The patch elements of add-on material are quadrilateral, specifically, generally rectangular, or generally square.

The circumferential offset, x, between (i) the patch elements 134*a*, 136*a* of the row 131*a* and (ii) the corresponding patch elements 134*b*, 136*b* of the adjacent row 131*b* preferably lies in the range of about 10% to about 35% of the total, unwrapped cross-measure of the bobbin. More preferably, the circumferential offset, x, lies in the range of about 12% to about 35% of the total, unwrapped cross-measure of the bobbin 140. Most preferably, the circumferential offset, x, is about half the circumferential dimension or cross-measure of the add-on row. The patch elements of add-on material in other rows, 131*c*, 131*d*, are likewise further offset circumferentially by the same offset, x, with respect to each other. In an embodiment, each row 131 of a row set 139 may be offset from one another in the range of about 3.5 to about 4 mm in the transverse direction, and in one example, by about 3.375 mm for a row set 139 of four rows 131 and a tobacco rod circumference of about 25 mm.

The pattern applied to establish rows 131*a*-131*d* is preferably repeated along the length of the base web 140. Clearly, if the circumferential offset, x, is less than 12.5% of the cross-directional width of the bobbin, more than four rows will define a complete cycle or phase length or pitch for the pattern 130. Conversely, if the circumferential offset, x, is greater than 12.5%, less than four rows will define a complete cycle for the pattern 139 (as in the case of the FIG. 2 pattern).

Figure 4:
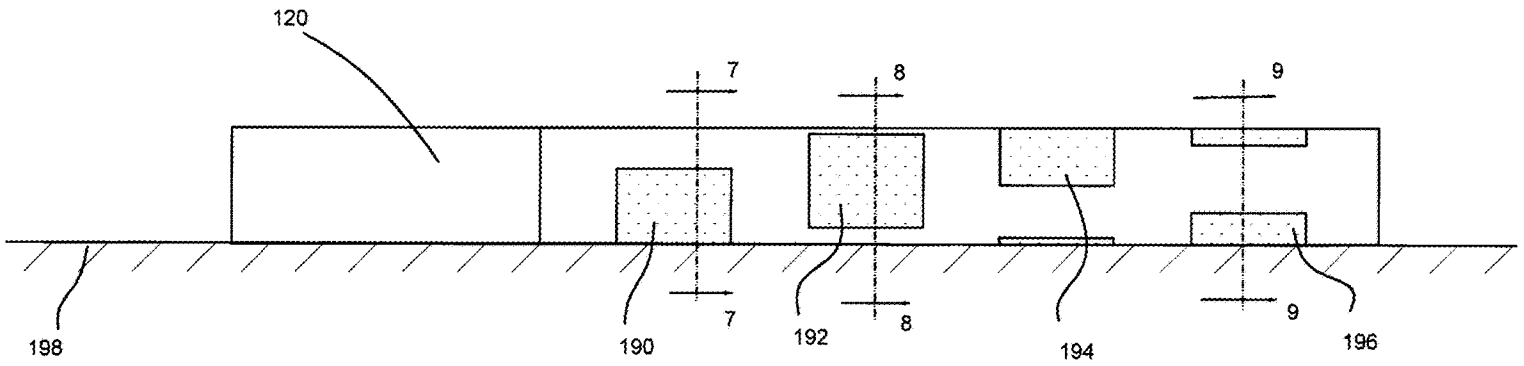
FIG. 4 is a side elevation of a smoking article according to the disclosure, placed against a substrate.
Figure 5:
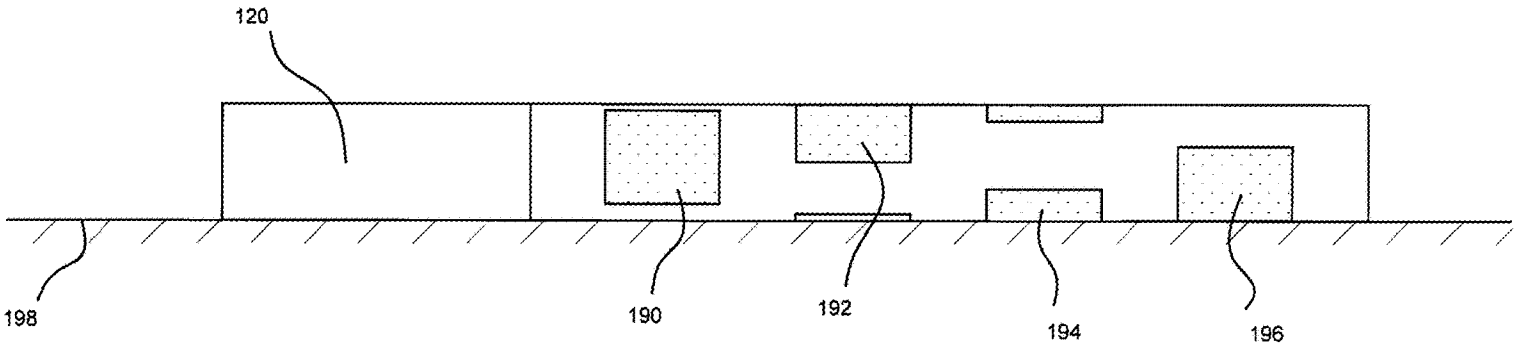
FIG. 5 is a side elevation of smoking article according to the disclosure, similar to FIG. 4, but rotated about 45° about the axis of the smoking article.
Figure 6:
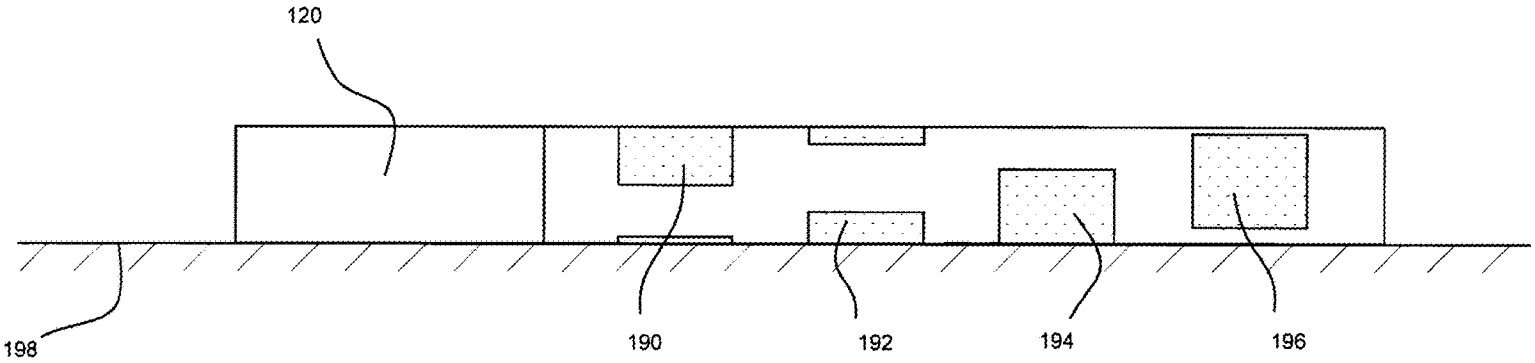
FIG. 6 is a side elevation of a smoking article according to the disclosure, similar to FIG. 4, but rotated about 90° about the axis of the smoking article.
Figure 11:
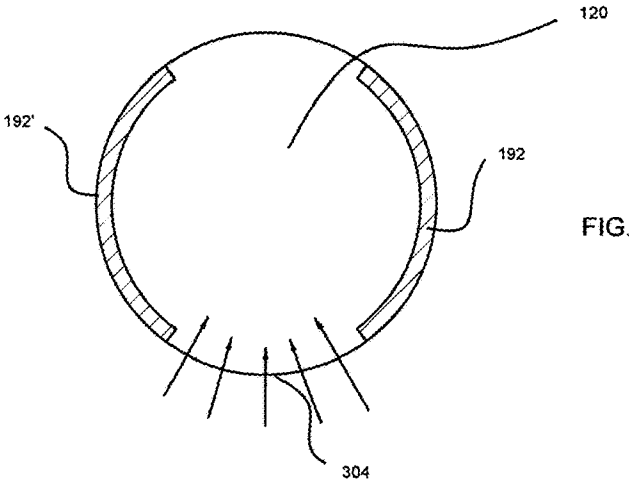
FIG. 11 is a transverse cross-sectional view of the smoking article of FIG. 1, similar to FIG. 10, but showing a free-burn condition.

Three different positions of the smoking article 120 resting on substrate 198 are illustrative of the cooperation which occurs between the patch elements of low permeability add-on material and the substrate 198. One position (see FIG. 4) illustrates a side view of the smoking article 120 according to this description. Rotation of the smoking article through a 45° angle about its longitudinal axis (clockwise from the left end of FIG. 4) results in an elevation similar to that shown in FIG. 5. Similarly, further rotation of the smoking article 120 through another 45° angle (also clockwise from the left end of FIG. 4) results in an elevation to that illustrated in FIG. 6. In each of FIGS. 4-6 it can be seen that at least one pair of patch elements of add-on material are positioned on the sides of the smoking article at a location along the length of the tobacco rod 122, e.g., patch elements 192, 192' (not shown) of FIG. 4, patch elements 194, 194' of FIG. 5, and patch elements 196, 196' of FIG. 6. At those locations where the patch elements of add-on material are positioned substantially on the sides of the smoking article 120 (FIG. 10), the patch elements 192, 192' are substantially upright or generally perpendicular to the surface of the substrate 198. That orientation of the patch elements 192, 192' is best illustrated in FIG. 11, where the opposed patch elements 192, 192' are located on corresponding opposed sides of the smoking article 120 when viewed in cross section, substantially symmetrically positioned relative to a diameter of the tobacco rod 122, which diameter is substantially parallel to the surface of the substrate 198.

Figure 9:
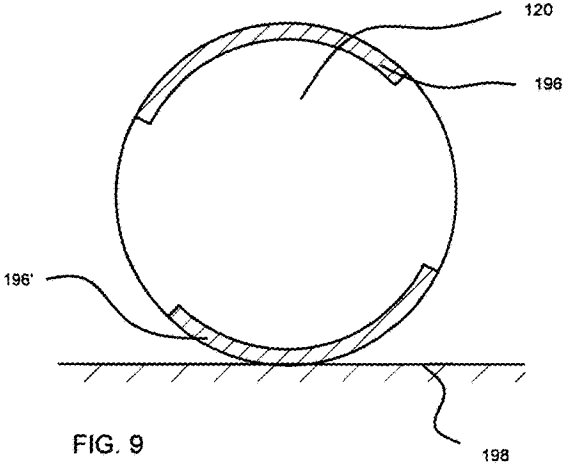
FIG. 9 is a cross-sectional view taken along the line 9-9 of FIG. 4.
Figure 8:
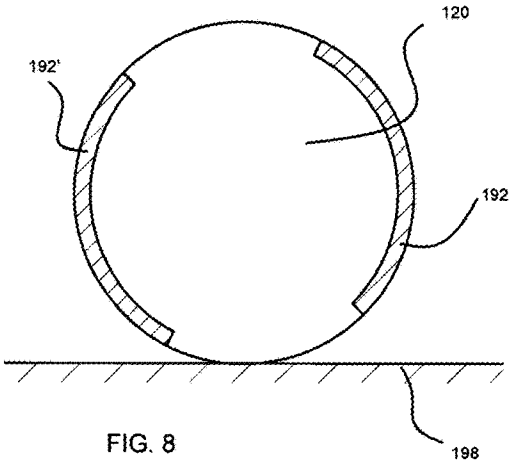
FIG. 8 is a cross-sectional view taken along the line 8-8 of FIG. 4.
Figure 7:
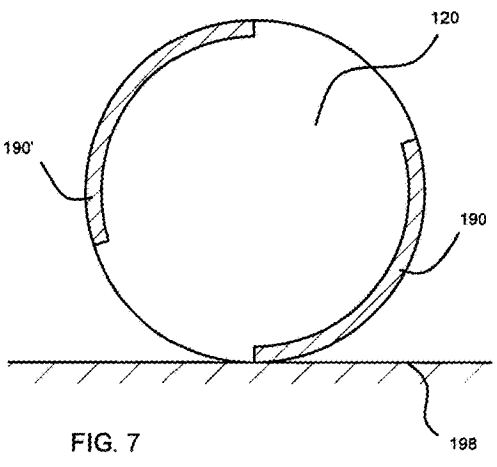
FIG. 7 is a cross-sectional view taken along the line 7-7 of FIG. 4.
Figure 10:
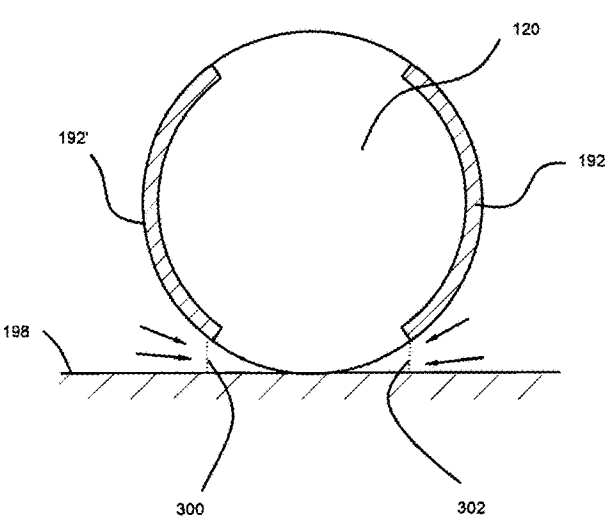
FIG. 10 is a transverse cross-sectional view of the smoking article of FIG. 1 with the patches oriented for optimal ignition propensity.

Orientation of the patch elements of add-on material at other longitudinal locations along the smoking article 120 are shown in FIGS. 7-9. In FIG. 7, the patch elements 190, 190' of add-on material are positioned such that one patch element 90 touches the substrate 198. In FIG. 9, one patch element 196' contacts the substrate 198, but the other opposed patch element 196 is located at the top of the smoking article 20. From consideration of FIGS. 7-9, it will be appreciated that regardless of the angular position of a smoking article 120 having the pattern of patch elements of add-on material described, at least one pair of opposed patch elements of add-on material are substantially positioned as shown in FIG. 10, or a slightly rotated position close thereto. This position has been referred to above as the oriented snuffer region 301.

When the smoking article 120 exists in free-burn condition (see FIG. 11), the patch elements 192, 192' obstruct airflow to the burning coal of the tobacco rod 122 by virtue of their reduced permeability. On the other hand, the bottom portion 304 of the wrapper paper freely permits air to enter the bottom or bottom side of the tobacco rod 122 to support combustion of the coal. A vastly different situation occurs when the smoking article 120 is placed on a substrate 198 (see FIG. 10). Here, the substrate 198 blocks the flow of air upwardly to the bottom portion 190 of the tobacco rod 122. The patch elements 192, 192' and the substrate 198 cooperate to define much smaller areas 300, 302 through which air can be delivered through the base web. More specifically, the vertical area 300 between the bottom of the patch element 192 and the substrate 198 and the vertical area 302 between the bottom of the patch element 192' and the substrate 198 present a substantial reduction in the area through which air can pass to reach the smoldering coal of the tobacco rod 122. As a result of deprivation of oxygen in the air, the smoldering coal self-extinguishes when the burn line reaches opposed patch elements of add-on material positioned as depicted in FIG. 10. The condition of substantially reduced area for air to support burning of the coal also exists for rotational positions of the tobacco rod 122 between that position illustrated in FIG. 10 and the position illustrated in FIG. 7 when the patch elements of add-on material do not contact the substrate 198, with FIG. 10 representing the position of most reduction in the area accessible to airflow. Similarly, if the smoking article is placed on a substrate 198 in a position where any of the other pairs of patch elements of add-on material have substantially the position shown in FIG. 10, self-extinction will also likely occur at such other pairs of patch elements.

However, when the smoking article is placed on the substrate 198 such that one of the add-on patch elements contacts the substrate 198, substantially as shown in FIG. 9, the add-on patch elements may sufficiently restrict the area through which air can pass to the base web, and there is a lesser degree of material cooperation between the substrate 198 and the add-on patch elements to effect a reduction in that area, in comparison to what occurs at the snuffer region(s) 301.

In the foregoing example, the reduction in IP value, reduction in SE value, and improved free-burn quality of a smoking article 120 having a wrapping paper with pattern 139 formed thereon is discussed in relation to a situation where the smoking article happens to be placed on a substrate 198 at one of three specific orientations, the orientations being spaced (off-set) 45° apart from each other. Naturally, the discussion proceeded in this manner for the sake of brevity. It will be readily understood that a pattern according to this description can extinguish the smoking article, regardless of which side portion rests against a substrate 198 and without a need for applying film-forming compound to the paper to such an extent that a desirable free-burn quality in the smoking article is lost. This may be understood by recognizing that opposing patch elements of film-forming compound need not appear at locations exactly 90 degrees from the side portion in contact with the substrate 198. Those patch elements may be centered at a location that is closer to or farther from the side portion in contact with the substrate 198, for example, between about 60° and 120° from the side portion in contact with the substrate 198. It is also contemplated that more than two patch elements 126 may comprise each row 131 of patches about a circumference of a smoking article 120.

Additionally, for a particular chosen pattern, the ability to extinguish the smoking article may depend more on providing minimum lengthwise extent of add-on material (e.g., a film-forming compound), rather than a particular weight per area of film-forming compound at longitudinal locations. The length of a rectangular patch element or patch, for example, may be no less than about 7 mm for a particular design, base web, and film-forming compound used. The amount of film-forming compound used may be increased to improve IP performance, usually without losing a free-burn quality, and if desired, a burn accelerator may be applied to the paper to support even higher add-on levels.

Preferably, the patches of add-on material reduce diffusivity of the wrapper paper to the range of from about 0 to about 0.2 cm/sec, and more preferably to the range of from about 0 to about 0.1 cm/sec.

Accordingly it is seen that the spirally rotated position of the opposed patch elements of add-on material creates a situation where, regardless of which side portion of the wrapper paper is placed against the substrate 198, there will always be at least one longitudinal location along the tobacco rod having patch elements disposed along opposite sides of the tobacco rod, not in contact with the substrate 198 yet having a sufficient geometry and add-on material to extinguish a smoldering smoking article when left unattended on the substrate 198. The arrangement permits a smoking article to be designed with an IP value no greater than 25% or less. In that each row 131 of patches includes uncoated areas between patch elements 126, the smoking article has a significantly improved SE performance during free burn. The arrangement enables a smoking article to be designed with an SE value of less than 50% and may be less than 25%.

In the embodiments described above, the smoking article has a generally circular cross section. Therefore, it is possible for any side portion of the smoking article to rest against the substrate 198. However, a pattern as taught herein can be such that the burn characteristics described above (IP values no greater than 25% and SE values no greater than 50%) in relation to FIGS. 10 and 11 can be realized, regardless of which side portion of the smoking article happens to rest against the substrate 198. Preferably, the pattern is selected so that when the base web is wrapped around a tobacco rod 122, patch elements of film-forming compound appear at opposing sides not in contact with the substrate 198 at one or more longitudinal locations along the tobacco rod 122. Having more than one longitudinal location with film-forming compound at the side positions is preferred so as to accommodate situations where the smoking article is placed on a substrate 198 after the burn line has advanced through a portion of the smoking article which would have extinguished the smoking article, or so that side patch elements of add-on material are always relatively close to a burn line when the smoking article is placed on the substrate 198.

If desired, the patch elements of add-on material may also comprise other geometric shapes other than quadrilaterals including, for example, ovals, other polygons, or the like.

The patch elements 126 of add-on material may be applied to the base web 140 preferably by a printing technique. While one or more printing technique (selected from the group consisting of direct printing, offset printing, inkjet printing, gravure printing, and the like) may be used to apply the patch element 126, preferably a gravure printing process will be used. Gravure printing provides ample control over deposition rates, deposition patterns, and the like, and is suitable for high-speed printing on the base web 140. For purposes of this disclosure, "high-speed" printing refers to printing processes where the base web 140 advances through the printing process at a linear speed greater than about 300 feet/min. For cigarette manufacturing purposes, base web printing speeds greater than 450 feet/min. are preferred, and speeds greater than 500 feet/minute or more are even more preferred. In this regard, the rates of deposition for add-on material, as well as the quality of the pattern of deposited add-on material, can vary considerably when wrapper prepared by high-speed printing processes is compared with wrapper prepared by low-speed printing processes. Higher-speed printing operations can achieve production of wrappers capable of providing both desirable IP values (performance) and desired SE values (performance).

Remarkably, it has been found that a base web may be converted (printed) to include patch elements in accordance with the embodiment described with reference to FIGS. 1 and 2 at about 1000 feet per minute with acceptable paper appearance (i.e., without quality defects) and without elevated or unacceptable statistical occurrences of creases or wrinkles.

This disclosure contemplates that various anti-wrinkling agents are suitable to attain the desired characteristics described herein. In particular, the anti-wrinkling agent is selected from the group consisting of glycerin, propylene glycol, and 1,2 propylene glycol. Propylene glycol is a preferred member of the anti-wrinkling agent group, however, 1,2 propylene glycol is the most preferred member of the anti-wrinkling agent group.

Patch elements 126 of this disclosure preferably comprise an aqueous solution containing starch, chalk or $CaCO_3$, and an anti-wrinkling agent. While many types of starch are contemplated, tapioca starch is presently preferred for the starch component of the layers of add-on material. A suitable commercially available starch is FLO-MAX8® available from National Starch, LLC (now Ingredion).

Many types of calcium carbonate particles are contemplated as falling within the spirit and scope of this disclosure. Presently, however, calcium carbonate available from Solvay Chemicals, Inc., as SOCAL 31 is a suitable commercially available calcium carbonate. SOCAL 31 is an ultrafine, precipitated form of calcium carbonate having an average particle size of about 70 nm (nanometers). Larger particles of calcium carbonate have been observed to not function as well in this application when compared to the ultrafine, precipitated form of calcium carbonate, due at least in part to the tendency of larger particles to precipitate from solution more quickly and due at least in part to the need for greater quantities to attain the beneficial characteristics discussed herein.

The film-forming compound can include one or more occluding agents such as starch, alginate, cellulose or gum and may also include calcium carbonate as a filler. Where starch is the film-forming compound, a concentration of about 21° A may be advantageous. The film-forming composition may be applied to the base web of the wrapper using gravure printing, digital printing, coating or spraying using a template, or any other suitable technique.

Uncoated areas of the base web preferably do not comprise and are essentially free of any permeability reducing add-on material.

The manufacture of base web 140 usually will include the production of a roll of base web of several feet across (usually about 3 feet across or in transverse dimension). The base web is then drawn through a printing press or the like and rewound to produce a roll of patterned paper, which is then slit into bobbins. Printing operations are preferably conducted on the rolls, but could be conducted after slitting. Preferably, the bobbins themselves will have a transverse dimension equivalent to the width needed to make tobacco rods 122 or an integral number of such widths (e.g., 1, 2, or 4 of such widths). The bobbins are adapted for use with typical cigarette making machinery. The wrapper preferably has a dimension in cross-direction that takes into account the nominal circumference of the tobacco rod and an overlapping seam. As a result, when the wrapper is slit, the smoking article formed therefrom always has a longitudinal seam with an exact overlap.

The base web advances or passes through a first gravure printing station where the first layer of each patch element is printed on the paper. The printing process may be applied to the "felt side" or the "wire side" of the base web, or both.

When an aqueous starch solution is being used as the add-on materials, its preparation for application before and at the printing press is preferably such that the add-on solution is maintained at or about 120° F. to about 140° F., as taught in U.S. patent application Ser. No. 13/324,747, filed Dec. 13, 2011.

Two illustrative examples for the geometric characteristics of the patch element have been found to be desirable. In a first arrangement, the patch elements may have a longitudinal length of about 7 mm, a circumferential dimension of about 8.25 mm. In a second arrangement, the patch elements may have a longitudinal length of about 8 mm, and a circumferential dimension of about 8.25 mm.

Printing Apparatus

Figure 12:
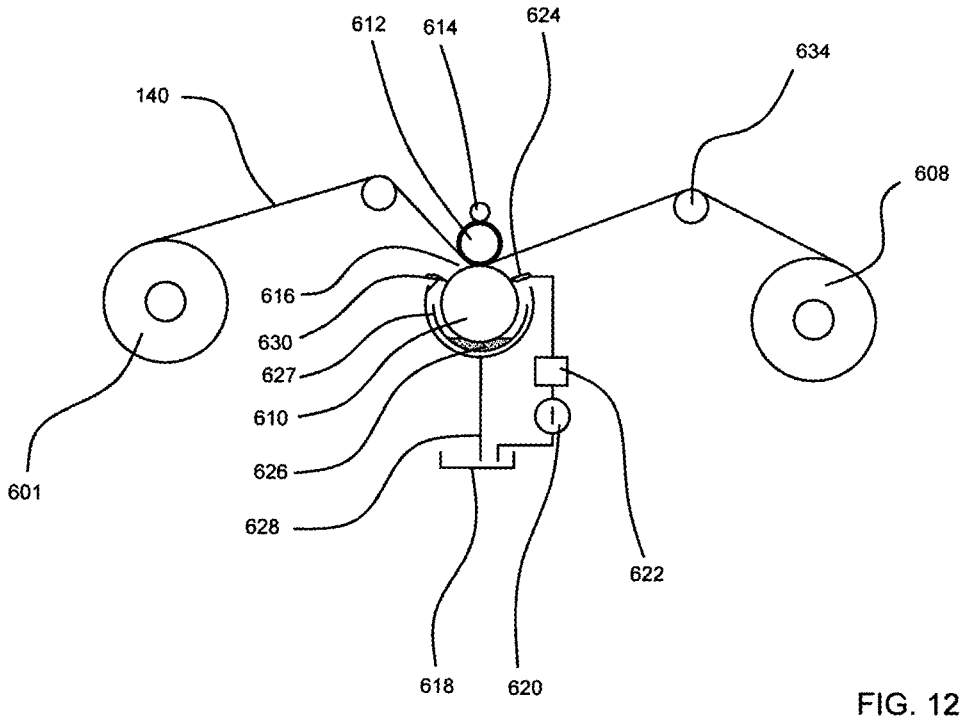
FIG. 12 is a schematic view of a gravure printing system.

Referring now to FIG. 12, a preferred printing apparatus includes a dispensing reel 601, a collection reel 608, an engraved printing cylinder (gravure roller) 610, an impression cylinder 612, an optional backing roller 614, a nip 616 defined between the cylinder 610 and 612, a reservoir of add-on material 618, a pump 620 operative to pump add-on material from the reservoir 618, a heat exchanger 622, an applicator 624, a bath 626, a collector 627, a drain 628, a doctor blade 630, and an idler roller 634.

The impression cylinder 612 is mounted for counter-rotation on an axis parallel to the axis of the printing cylinder (or gravure roller) 610. In some applications, the impression cylinder includes a nonmetallic resilient surface. The impression cylinder is positioned between the roller and an optional backing roller 614, which is also mounted for rotation on an axis parallel to the axis of gravure the roller 610 and which counter-rotates relative to the impression cylinder. One of the functions provided by the optional backing roller 614 is stiffening the central portions of the impression cylinder so that the uniform printing pressure is obtained between the gravure roller 610 and the impression cylinder 612. The gravure roller 610 and the impression cylinder 612 cooperate to define a nip 616 through which the base web is drawn during the printing process. The nip 616 is sized to pinch the base web as it moves between the gravure cylinder 610 and the impression cylinder 612. The nip pressure 612 on the base web ensures the correct transfer of the add-on material from the gravure roller 610 to the paper base web 140.

In a preferred embodiment, the reservoir 628 contains the occlusive composition (add-on material), preferably an aqueous starch solution as discussed above for forming patch elements 126 on the base web 140. The reservoir communicates with a suitable pump 610 which is capable of handling the viscous occlusive composition. The occlusive composition may then flow to a suitable heat exchanger 622 where the temperature of the occlusive composition is elevated so that it lies in the range of about 40° to about 90° C. (about 120° F. to about 140° F.) so that the viscosity of the occlusive composition is adjusted to a level which is suitable for gravure printing and for maintain desired conditions of the starch solution. As discussed above, gravure printing usually requires a viscosity of less than about 200 cP. Preferably, the temperature of the occlusive composition is selected so that the viscosity is less than about 100 cP. For example, the occlusive composition may have a viscosity of about 10-40 cP at about 120° F.

While a separate heat exchanger 622 is disclosed, it may be desirable to provide thermal conditioning of the occlusive composition in the reservoir 618 itself. For example, heating elements and stirring apparatus may be included in the reservoir 618 to maintain the elevated temperature for the occlusive composition. Placement of the thermal conditioning in the reservoir has the advantage of making pump selection and operating requirements simpler since the pump need not handle the occlusive composition at the higher viscosity associated with lower temperatures because the occlusive composition would already be heated and, therefore, at the lower viscosity. Whether thermal conditioning occurs in the reservoir or in a separate heat exchanger, it is important that the thermal conditioning step occur at a controlled temperature selected to avoid scorching the occlusive composition. Scorching can cause discoloration of the occlusive composition, and can affect the occlusive characteristics of the composition.

Additionally, it is important to maintain an aqueous starch solution at or about the range of about 120° F. to 140° F. prior to and during printing operations. Aqueous starch solutions tend to degrade irreversibly if allowed to drop below those temperatures.

Regardless of where the thermal conditioning step occurs, the heated occlusive composition is preferably delivered to a suitable applicator 624 that spreads the occlusive composition across the width of the gravure cylinder. That spreading step may be effected by pouring or spraying the occlusive composition onto the gravure cylinder, or by delivering the liquid occlusive composition to a collector 627 to establish a bath 626 of occlusive composition in contact with a lower portion of the gravure cylinder 610. The gravure cylinder 610 may be heated to prevent premature cooling of the composition.

Generally, the collector 627 extends partially about the gravure roller to a height sufficient to collect the bath, but to a height well below the top of the gravure cylinder 610. When the bath reaches the top of the collector, occlusive composition can flow through a drain 628 at the bottom of the apparatus back into the reservoir. Thus, the occlusive composition circulates through the printing station and can be maintained at suitable printing viscosity by the thermal conditioning apparatus discussed above.

Printing Cylinder

Figure 13:
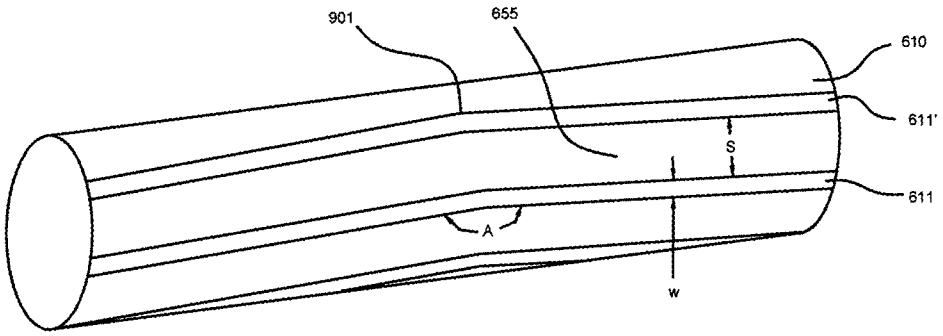
FIG. 13 is schematic perspective view of a gravure roller according to the disclosure.

Referring now to FIG. 13, the preferred embodiment includes an engraved printing cylinder (print roller) 610 having a plurality of engraved regions 611, 611' in spaced-apart relation about the circumference of the cylinder 610 corresponding to the desired width "w" of the patch elements and the desired spacing "s" between bands or rows as indicated by arrows "w" and "s" respectively, in FIG. 13. The details of the engraved regions 611, 611' and the printed rows 131, 131' have been omitted in FIGS. 13 and 14, respectively, but the omitted details would correspond with those appearing as printed rows 131, 131' in FIG. 14. Preferably the engraved regions 611 are each slightly angulated in the form of a chevron. The angle "A" at the tip 901 of the chevron is greater than about 170 degrees. Such arrangement helps to further relieve stress in the paper base web 140 upon application of the add-on material, by spreading any puckering or wrinkling in opposing directions on the left and right halves of the web along the machine direction. It is envisioned that the engraved regions 611 might be instead arranged linearly without any chevron.

Preferably, the circumference of the roller is determined such that it is an integer multiple of the sum of the nominal distance between patch elements plus the patch element width. Thus, for each revolution of the roller, that predetermined integer number of patch elements is printed on the base web 140.

Printing consistency and efficiency is further enhanced by elevating nip-pressure at the press. In a preferred embodiment, a nip pressure was increased by approximately 10 to 15%, e.g., from the normally applied pressure for the genre of printing operation.

Figure 14:
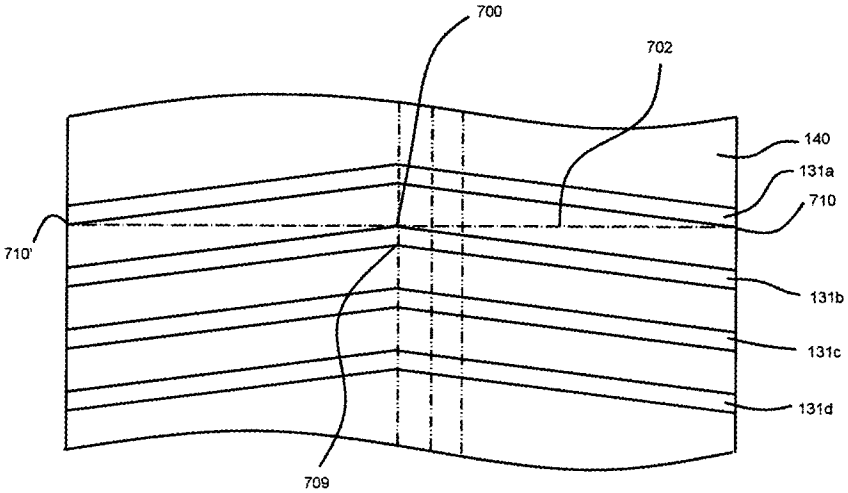
FIG. 14 is a plan view of a base web with representation in outline of areas where patch elements are applied.

In the preferred embodiment, as shown in FIG. 14, each web 140 is printed with multiple rows 131 of patch elements 126 along the length thereof. Preferably, the patch elements 126 are printed in a chevron pattern on the base web (prior to slitting) such that the apex 700 in the leading edge of each patch element 126 (FIG. 1) is essentially transversely disposed of the outer points 710, 710' (FIG. 14) on the trailing edge 148 (FIG. 1) of the preceding patch element 126. In other words, the apex 700 (FIG. 14) and the outer points 710, 710' essentially lie along an imaginary transverse line 702. It is envisioned that the angle at the apex 700 may be adjusted to re-establish the aforementioned relationship if the roll width is increased or decreased. Preferably, the apex angle lies in the range of about 0.5° to about 5°. In the alternative, the apex 700 may be established slightly ahead in a machine direction of outer points 710, 710' of an adjacent patch element 126.

The etched regions 611, 611' (FIG. 13) of the gravure roller 610 are configured and mutually arranged correspondingly. This chevron shape and relationship helps avoid excessive waviness in the web as a result of printing operations so that rewinding the printed web and the slitting the web into bobbins may be conducted without unacceptable occurrences of creases and tears. More particularly, it is to be noted that along any transverse region (or imaginary line) across the entire base web 140 after application of the add-on composition, the transverse region will include portions of the base web 140 that are not treated with add-on material as well as portions that are treated with add-on material. In contrast, without the chevrons (i.e., the patch elements are arranged straight across the web), the shrinking effect of the aqueous add-on material during drying is localized at the location of the bands such that some transverse regions of the web is subject to all the shrinking effect and some adjacent transverse regions are not, which circumstance is known to exacerbate waviness, which in turn leads to creasing and tears in the web during rewinding and slitting.

With the chevrons (FIG. 14) the shrinking effect of the add-on composition is distributed with a longitudinal component and no longer does any thin, imaginary transverse region bear the entirety of an application of add-on material. Consequently, tendencies for creasing and tearing are abated. Accordingly, when the add-on material is dried, the related transverse web shrinkage is not localized in the printed (i.e., patch) areas, rather that shrinkage rate gradually increases from a minimum value at the leading at the apex 700 to the trailing edge apex 709 at the apex, and remains substantially constant until the leading edge 146 (FIG. 1) of the band (the respective row 131) reaches the lateral edge of the band (FIG. 14). From that location, the shrinkage decreases until the trailing edge of the band where the minimum shrinkage value exists. Thus, rather than step-wise shrinkage discontinuity, the chevron printing design gives gradual shrinkage variation and results in reduced waviness compared to prior techniques which used parallel bands disposed perpendicularly across the base web.

Still referring to FIG. 14, once the base web 140 has been printed with the chevron shaped rows 131 of patch element 126, the base web is rolled and then slit longitudinally into a plurality of parallel ribbons that are wound into bobbins. Typically the base web may have a transverse width of about 50 inches, while individual ribbons may have a transverse width of about 26 to 28 mm or multiples thereof with a length of material on the order of 6,000 meters. Accordingly, the base web 140 of about 50 inch width generates about 45 to about 50 ribbons or bobbins. Each individual ribbon is collected by tightly winding it on a corresponding bobbin, where each bobbin may have a length of material on the order of 6,000 meters. The bobbins may then be used in conventional cigarette making machinery in combination with tobacco material to form a tobacco rod. The tobacco rods are then severed at predetermined lengths, such that filters can be attached with tipping paper to form finished cigarettes or smoking articles.

Examples

In a first example of a preferred embodiment, bobbins of 33 CORESTA patch wrapper were constructed with each patch element 126 being approximately 8 mm in width and approximately 8.25 mm in cross measure, with an approximately 8.45 mm band spacing (between adjacent rows 131) and an approximately 5.25 mm circumferential spacing or gap (corresponding to designation 166 in FIG. 2) between the patch elements 126. The add-on solution comprised water, starch, calcium carbonate and 1,2 propylene glycol. The add-on material was applied in a single pass gravure printing operation utilizing chevron and solution preparation and thermal maintenance as taught herein. The target diffusivity value was zero at the patch elements and row sets 129 comprised four rows 131. Cigarettes were constructed with the wrappers and tested for IP and SE performance, with the results of an overall average IP of 7.7% and an overall average SE value of 31%. Such is a significant and surprisingly low SE value coupled with acceptable IP performance. A second test resulted an overall average IP of 21.9% and an overall average SE value of 23.6%.

In a second example of a preferred embodiment, bobbins of 33 CORESTA patch wrapper were constructed with each patch element 126 being approximately 7 mm in width and approximately 8.25 mm in cross measure, with an approximately 9.45 mm band spacing (between adjacent rows 131) and an approximately 5.25 mm circumferential spacing or gap (corresponding to designation 166 in FIG. 2) between the patch elements 126. The add-on solution comprised water, starch, calcium carbonate and 1,2 propylene glycol. The add-on material was applied in a single pass gravure printing operation utilizing chevron and solution preparation and thermal maintenance as taught herein. The target diffusivity value was zero at the patch elements and row sets comprised four rows. Cigarettes were constructed with the wrappers and tested for IP and SE performance, with the results of an overall average IP of 13.4% and an overall average SE value of 23.6%. Such is a significant and surprisingly low SE value coupled with acceptable IP performance. A second test resulted an overall average IP of 28.1% and an overall average SE value of 21.7%.

It will now be apparent to those skilled in the art that this specification describes a new, useful, and nonobvious smoking article. It will also be apparent to those skilled in the art that numerous modifications, variations, substitutes, and equivalents exist for various aspects of the smoking article that have been described in the detailed description above. Accordingly, it is expressly intended that all such modifications, variations, substitutions, and equivalents that fall within the spirit and scope of the invention, as defined by the appended claims, be embraced thereby.

We claim:

1. A process of preparing an aqueous starch solution suitable for printing, the process comprising:

contacting water and a starch to form an aqueous starch solution;

heating the aqueous starch solution at a first temperature, the first temperature being greater than about 180° F., holding the aqueous starch solution at the first temperature for a first time period, the first time period being sufficient to release at least one of amylopectin and amylose;

contacting propylene glycol with the aqueous starch solution during the first time period in a sufficient quantity to form a printable solution having anti-wrinkling and anti-microbial properties;

after the first time period, cooling the printable solution to a second temperature, the second temperature being greater than or equal to about 120° F. to less than or equal to about 150° F.; and holding the printable solution at the second temperature for a second time period, the second time period continuing until the printable solution is utilized in printing to reduce premature gelation of the printable solution.

2. The process of claim 1, wherein the starch is oxidized starch.

3. A process of preparing an aqueous starch solution suitable for printing comprising:

contacting water and a starch to form an aqueous starch solution;

heating the aqueous starch solution to a first temperature, the first temperature being greater than about 180° F.;

holding the aqueous starch solution at the first temperature for a first time period, the first period being sufficient release at least one of amylopectin and amylose;

contacting propylene glycol to the aqueous starch solution during the first time period in sufficient quantity to provide a printable solution having anti-wrinkling and anti-microbial capacities;

after the first time period, cooling the printable solution to a second temperature, the second temperature being greater than or equal to about 120° F. to less than or equal to about 150° F.;

holding the printable solution at the second temperature until utilized in printing so as to reduce gelation of the printable solution; and contacting calcium carbonate to the printable solution before the printing.

4. A process of preparing an aqueous starch solution suitable for printing comprising:

establishing an aqueous starch mixture by mixing water and a starch;

heating the aqueous starch mixture to a first temperature, the first temperature being sufficient to establish a cooked aqueous starch solution; and stabilizing the cooked aqueous starch solution, the stabilizing including:

holding the cooked aqueous starch solution at the first temperature for a first time period, the first time period being sufficient to release at least one of amylopectin and amylose;

adding a stabilizing agent to the cooked aqueous starch solution during the first time period so as to form a stabilized, cooked aqueous starch solution; and maintaining the stabilized, cooked aqueous starch solution at a second temperature greater than or equal to about 120° F. to less than or equal to about 140° F. until the stabilized, cooked aqueous starch solution is utilized in printing so as to reduce gelation of the printable solution.

5. The process of claim 4, wherein the stabilizing agent is propylene glycol and the propylene glycol is added in an amount greater than or equal to about 7% to less than or equal to about 10% by weight based on the weight of the cooked aqueous starch solution.

* * * * *